US008128213B2

(12) United States Patent
Umeda

(10) Patent No.: US 8,128,213 B2
(45) Date of Patent: Mar. 6, 2012

(54) LIQUID EJECTOR

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 12/326,070

(22) Filed: Dec. 1, 2008

(65) Prior Publication Data

US 2009/0141095 A1 Jun. 4, 2009

(30) Foreign Application Priority Data

Nov. 29, 2007 (JP) ..... 2007-308178

(51) Int. Cl.
*B41J 2/18* (2006.01)

(52) U.S. Cl. ..... 347/89

(58) Field of Classification Search ..... 347/85, 347/89

See application file for complete search history.

(56) References Cited

U.S. PATENT DOCUMENTS

| | | | | |
|---|---|---|---|---|
| 5,113,206 | A | 5/1992 | Fukazawa | |
| 6,312,094 | B1 | 11/2001 | Ito et al. | |
| 6,976,746 | B2 * | 12/2005 | Shimamura | 347/7 |
| 2005/0195225 | A1 | 9/2005 | Takagi et al. | |
| 2006/0164482 | A1 * | 7/2006 | Katayama et al. | 347/86 |

FOREIGN PATENT DOCUMENTS

| | | | |
|---|---|---|---|
| JP | H02-000526 | A | 1/1990 |
| JP | H02-011334 | A | 1/1990 |
| JP | H02-016057 | A | 1/1990 |
| JP | H07-304190 | A | 11/1995 |
| JP | H11-263026 | A | 9/1999 |
| JP | H11-334110 | A | 12/1999 |
| JP | 2001-310487 | A | 11/2001 |
| JP | 2005-246781 | A | 9/2005 |
| JP | 2006-281508 | A | 10/2006 |
| JP | 2007-237664 | A | 9/2007 |

OTHER PUBLICATIONS

Japan Patent Office, Notice of Reasons for Rejection for Japanese Patent Application No. 2007-308178 (counterpart to above-captioned patent application), mailed Dec. 6, 2011.

* cited by examiner

*Primary Examiner* — Mark Robinson
*Assistant Examiner* — Erin Chiem
(74) *Attorney, Agent, or Firm* — Baker Botts L.L.P.

(57) ABSTRACT

A liquid cartridge which is used and is in the empty state is attached to the second cartridge attaching unit. When the attachment detector has detected that the liquid cartridge is attached to the second cartridge attaching unit and the second empty detector has detected that the liquid cartridge is in an empty state, the control unit controls the pump in such a way that a predetermined conveyance amount of the liquid is conveyed to the liquid cartridge attached to the second cartridge attaching unit after the liquid is conveyed from the discharge path to the liquid cartridge until the second empty detector detects that the liquid cartridge is no longer in the empty state.

10 Claims, 12 Drawing Sheets

LIQUID EJECTOR

CROSS REFERENCE TO RELATED APPLICATION

The present application claims priority from Japanese Patent Application No. 2007-308178, which was filed on Nov. 29, 2007, the disclosure of which is herein incorporated by reference in its entirety.

BACKGROUND OF THE INVENTION

1. Field of the Invention

The present invention relates to a liquid ejector which ejects a liquid from a nozzle.

2. Description of Related Art

Japanese Unexamined Patent Publication No. 2-16057 discloses an inkjet recording apparatus which is arranged so that, in a case for example where nozzles of a record head are clogged because of thickened ink, a suction pump is driven while a cap is put on a head face where the nozzles are formed, so that the thickened ink or the like is sucked and then the sucked ink is conveyed to an waste ink cartridge. This makes it possible to continue the sucking of ink from the record head after the waste ink cartridge is replaced with another one, thereby elongating the life of the inkjet recording apparatus.

SUMMARY OF THE INVENTION

The inkjet recording apparatus disclosed in Japanese Unexamined Patent Publication No. 2-16057, however, is disadvantageous in that, since the waste ink cartridge has a predetermined capacity for storing ink, ink overflows from the waste ink cartridge when an amount of conveyed ink is larger than the capacity of the waste ink cartridge. To solve this problem of ink overflow, the inventor of the present invention realized the necessity of a mechanism that adjusts an amount of ink conveyed to the waste ink cartridge. However, the structure of the liquid ejector becomes complicated when a dedicated mechanism is additionally provided therein.

An object of the present invention is to provide a liquid ejector with a simple structure and long life.

The first aspect of the present invention is to provide a liquid ejector which includes: a liquid ejection head, a first cartridge attaching unit, a discharge path, a second cartridge attaching unit, a pump, a first empty detector, an attachment detector, a second empty detector, and a control unit. The liquid ejection head ejects a liquid through a nozzle. Attached to the first cartridge attaching unit is a liquid cartridge in such a way that a liquid is supplyable to the liquid ejection head. The liquid cartridge includes a section for detection. The section for detection is used for detecting whether the liquid cartridge is in an empty state in which an amount of an internal liquid is smaller than a predetermined remaining amount. The discharge path is used for discharging the liquid from the liquid ejection head. Attached to the second cartridge attaching unit is a liquid cartridge which is used and is in the empty state because a liquid therein has been consumed, so that the used liquid cartridge is connected to a downstream end of the discharge path. The pump is provided in the middle of the discharge path and conveys a liquid in the discharge path to the liquid cartridge attached to the second cartridge attaching unit. The first empty detector detects, using the section for detection, whether the liquid cartridge attached to the first cartridge attaching unit is in the empty state. The attachment detector detects whether the liquid cartridge is attached to the second cartridge attaching unit. The second empty detector detects, using the section for detection, whether the liquid cartridge attached to the second cartridge attaching unit is in the empty state. The control unit controls the pump. When an discharge possible state is established where the attachment detector has detected that the liquid cartridge is attached to the second cartridge attaching unit and the second empty detector has detected that the liquid cartridge is in the empty state, the control unit controls the pump in such a way that a predetermined conveyance amount of the liquid is conveyed to the liquid cartridge attached to the second cartridge attaching unit after the liquid is conveyed from the discharge path to the liquid cartridge until the second empty detector detects that the liquid cartridge is no longer in the empty state.

According to the present invention, because the liquid discharged from the liquid ejection head to the discharge path is conveyed by the pump to the liquid cartridge attached to the second cartridge attaching unit, it is possible to continue the discharge of the liquid from the liquid ejection head to the discharge path after the liquid cartridge attached to the second cartridge attaching unit is replaced with another one. This elongates the life of the liquid ejector.

Furthermore, after an amount of the liquid in the liquid cartridge attached to the second cartridge attaching unit becomes equal to or more than a predetermined remaining amount, only a predetermined conveyance amount of liquid is further conveyed to the liquid cartridge. It is therefore possible to prevent the liquid from overflowing from the cartridge if the predetermined conveyance amount is suitably set.

In addition to the above, an amount of liquid conveyed to the liquid cartridge attached to the second cartridge attaching unit is adjustable using the section for detection which is provided in the liquid cartridge and is used for detecting whether the liquid cartridge is in the empty state. For this reason a dedicated mechanism for adjusting the conveyance amount of the liquid is unnecessary, and hence the structure of the liquid ejector is kept simple.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred embodiment of the present invention.

Figure 1:
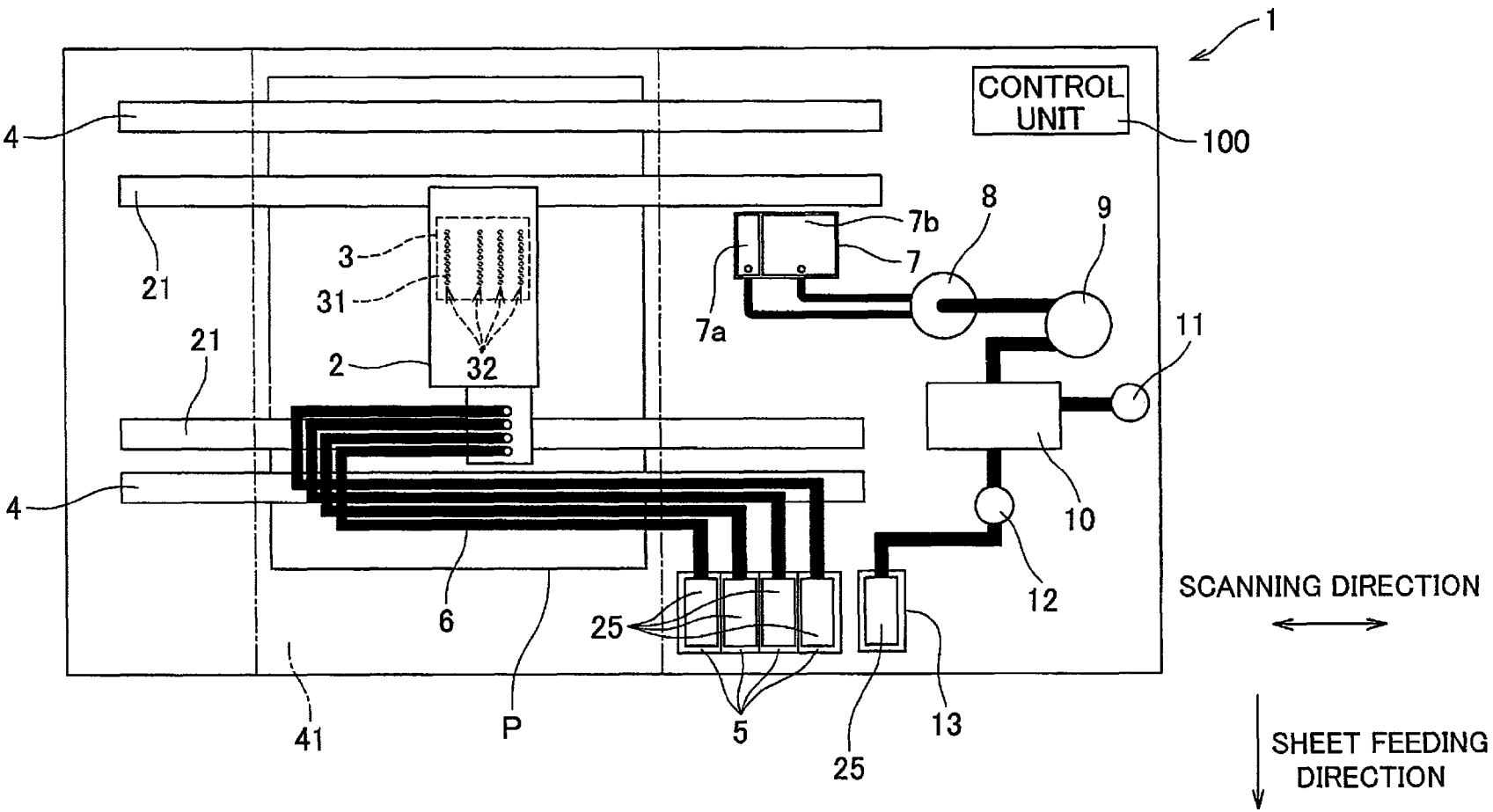
FIG. 1 is a schematic diagram of a printer of an embodiment of the present invention.
Figure 2:
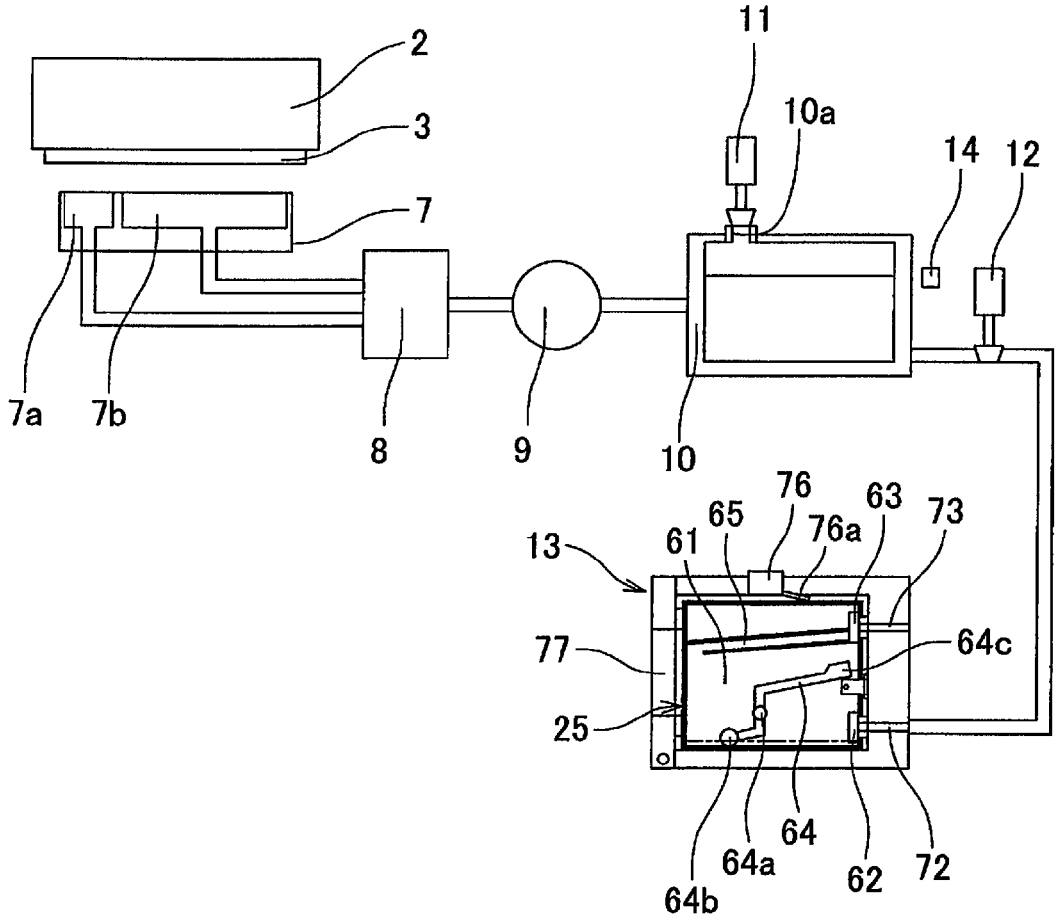
FIG. 2 shows the ink discharge path of FIG. 1.

FIG. 1 is a schematic diagram of a printer of the present invention. FIG. 2 illustrates an ink discharge path which has the upstream end connected to a later-detailed suction cap 7 of FIG. 1 and the downstream end connected to a second cartridge attaching unit 13. As shown in FIGS. 1 and 2, the printer 1 which is a liquid ejector includes components such as a carriage 2, an inkjet head 3, a sheet feeding roller 4, a first cartridge attaching unit 5, tubes 6, a suction cap 7, a switching unit 8, a pump 9, a storage tank 10, and the second cartridge attaching unit 13. The operation of the printer 1 is controlled by the control unit 100.

The carriage 2 is driven by an unillustrated driver so as to reciprocate along the scanning directions in parallel to the crosswise direction in FIG. 1, i.e. reciprocate in the scanning directions along two guides 21 extending perpendicular to a predetermined direction. These two guides 21 extend, in both scanning directions, beyond the boundaries of a sheet conveyance path 41 on which later-described record sheets P are carried. This allows the carriage 2 to reciprocate in the scanning directions beyond the boundaries of the sheet conveyance path 41.

The inkjet head 3 is disposed on the lower surface of the carriage 2. The inkjet head 3 has plural nozzles 31 on its lower surface, and ejects ink from the nozzles 31 by pressurizing, by using an unillustrated piezoelectric actuator, ink in an unillustrated pressure chamber which communicates with the nozzles 31. The nozzles 31 are aligned along a sheet feeding direction in parallel to the vertical directions in FIG. 1, so as to constitute nozzle strings 32. Four nozzle strings 32 are aligned in parallel to the scanning directions. From the leftmost string to the rightmost string in FIG. 1, these four nozzle strings 32 respectively eject black, yellow, cyan, and magenta inks from the nozzles 31 constituting each of them.

Along the sheet conveyance path 41, the sheet feeding roller 4, which is a liquid target medium carrier unit, carries a record sheet P which is a liquid target medium in a sheet feeding direction toward the bottom of FIG. 1, i.e. in a predetermined direction. In the printer 1, ink is ejected from the nozzles 31 of the inkjet head 3 reciprocating in the scanning directions along with the carriage 2 to a record sheet P carried in the sheet feeding direction by the sheet feeding roller 4, so that the ink lands on the record sheet P. In this way printing is done on the record sheet P.

The first cartridge attaching unit 5 is disposed to be adjacent to the lower right end of the sheet conveyance path 41 in FIG. 1. To the first cartridge attaching unit 5, it is possible to attach ink cartridges 25 filled respectively with black, yellow, cyan, and magenta inks.

Figure 3A:
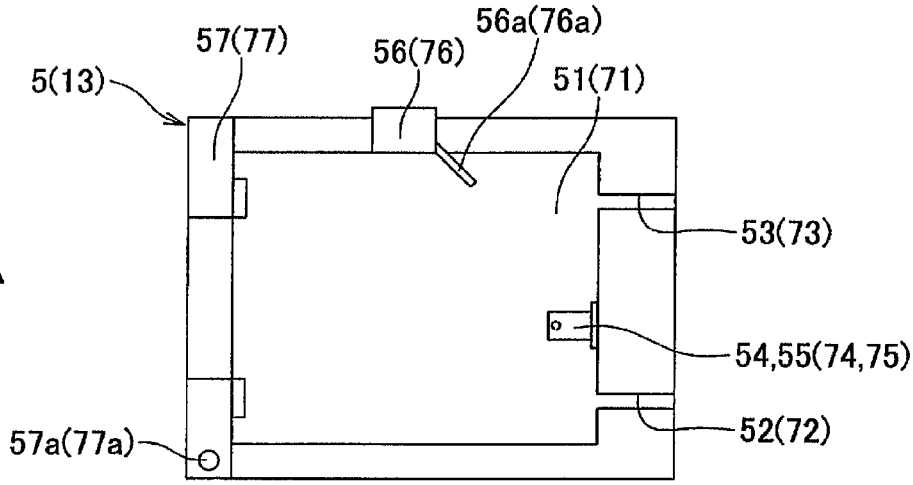
FIG. 3A is a profile of the first or second cartridge attaching unit of FIG. 1, when an ink cartridge is not attached.
Figure 3B:
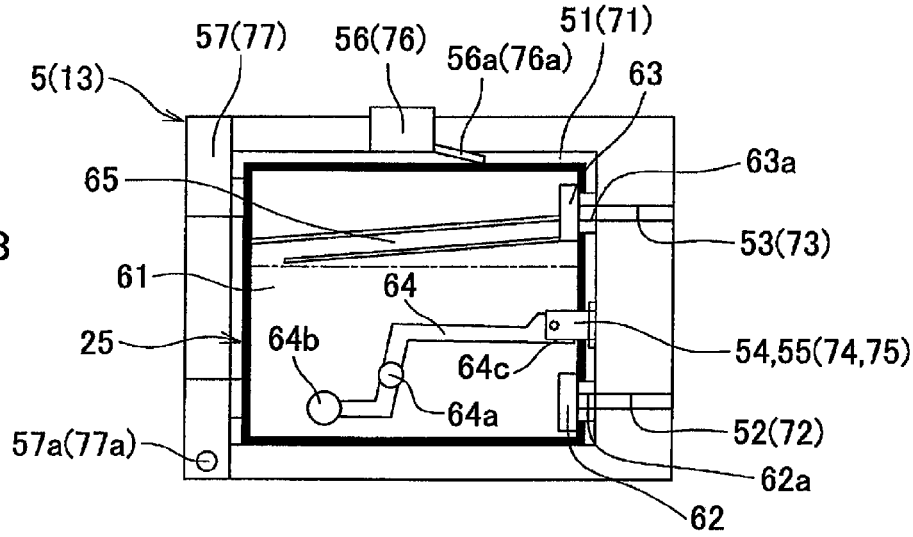
FIG. 3B is a profile of the first or second cartridge attaching unit of FIG. 1, when an ink cartridge in which a predetermined amount or more of ink remains is attached.
Figure 3C:
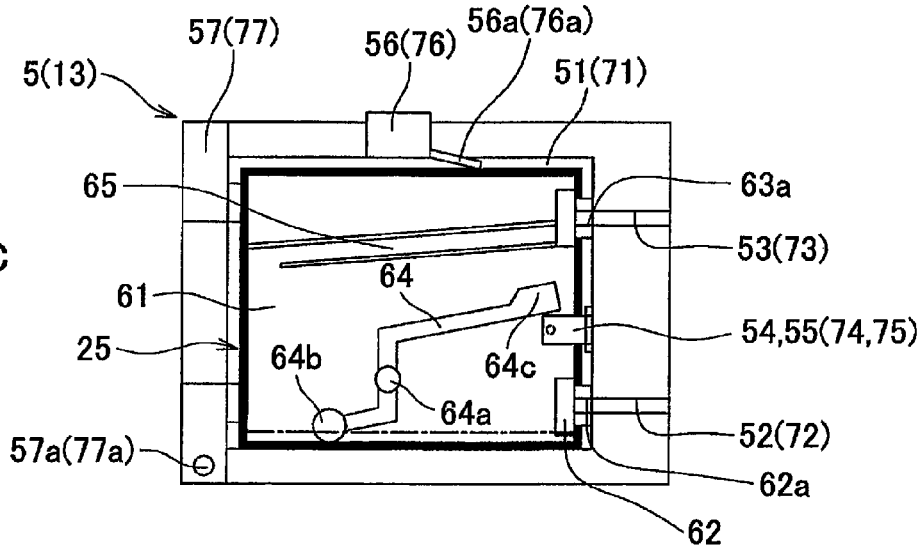
FIG. 3C is a profile of the first or second cartridge attaching unit of FIG. 1, when an ink cartridge in which the amount of remaining ink is smaller than the predetermined amount is attached.

Now, the first cartridge attaching unit 5 and the ink cartridges 25 are detailed. FIG. 3A is a profile of the first cartridge attaching unit 5, when no ink cartridge 25 is attached. FIG. 3B is a profile of the first cartridge attaching unit 5 attached to which is an ink cartridge 25 in which a predetermined amount or more of ink remains, i.e. an ink cartridge 25 which is not in the empty state. FIG. 3C is a profile of the first cartridge attaching unit 5 attached to which is an ink cartridge 25 in which the amount of remaining ink is lower than the predetermined amount, i.e. an ink cartridge 25 in the empty state.

As illustrated in FIGS. 3A to 3C, the first cartridge attaching unit 5 has a cartridge storage space 51, an ink flow path 52, an air hole 53, a light emitting unit 54 which is a first light emitting unit, a light receiving unit 55 which is a first light receiving unit, an attaching sensor 56, and a lid 57. The cartridge storage space 51 is a space which is open to the left side in FIGS. 3A to 3C. An ink cartridge 25 is inserted into the cartridge storage space 51 through the opening on the left side of FIGS. 3A to 3C.

The ink flow path 52 extends to the right from the vicinity of the lower end of the right wall of the cartridge storage space 51 in FIGS. 3A to 3C. The right end of the ink flow path 52 is connected to the inkjet head 3 via the tube 6. The air hole 53 extends to the right from the vicinity of the upper end of the right wall of the cartridge storage space 51 in FIGS. 3A to 3C. This air hole 53 is open to the outside air.

The light emitting unit 54 and the light receiving unit 55 are provided on the right wall of the first cartridge attaching unit 5 in FIG. 3 and oppose each other over the cartridge storage space 51 in the direction perpendicular to the surfaces of FIGS. 3A to 3C. The light emitting unit 54 emits laser light towards the light receiving unit 55. The light receiving unit 55 receives laser light from the light emitting unit 54. As discussed later, whether a remaining amount of ink in the ink cartridge 25 attached to the first cartridge attaching unit 5 is smaller than a predetermined remaining amount, i.e. whether the ink cartridge 25 is in the empty state is detectable based on whether the light receiving unit 55 receives laser light from the light emitting unit 54.

The attaching sensor 56 is disposed in the wall which defines the upper face of the cartridge storage space 51. From the lower end of this sensor 56, the lever 56*a* extends so as to reach the inside of the cartridge storage space 51. As illustrated in FIG. 3B and FIG. 3C, it is detected that an ink cartridge 25 is attached to the first cartridge attaching unit 5 when it is detected that a lever 56*a* is lifted up because the ink cartridge 25 is attached to the first cartridge attaching unit 5.

The lid 57 is used for closing the opening of the cartridge storage space 51, which is on the left side in FIGS. 3A to 3C. The lid 57 is rotatable about a fulcrum 57*a* which is provided at the lower end thereof. In FIGS. 3A to 3C, the lid 57 covers the aforesaid opening of the cartridge storage space 51. The lid 57 in this state is rotated anticlockwise for about 180° so that the opening of the cartridge storage space 51 is uncovered, and through this opening an ink cartridge 25 is inserted into the cartridge storage space 51. An ink cartridge 25 is attached to the cartridge storage space 51 in this way. As shown in FIG. 3B and FIG. 3C, when the ink cartridge 25 is attached to the cartridge storage space 51 and the lid 57 covers the opening of the cartridge storage space 51, the lid 57 pushes the left-side wall of the ink cartridge 25 in FIGS. 3A to 3C toward the right edge of each figure. This ensures the adhesion between the ink flow path 52 and a later-detailed ink supplying unit 62 of the ink cartridge 25 and between the air hole 53 and a later-detailed outside-air passage unit 63 of the ink cartridge 25.

The ink cartridge 25 has a substantially cuboid shape and includes an ink storage space 61, the ink supplying unit 62, an outside-air passage unit 63, a rotating component 64, and an air passage 65. The ink storage space 61 which is a liquid storage space is filled with ink which is to be supplied to the inkjet head 3.

The ink supplying unit 62 is disposed in the vicinity of the lower end of the right-side wall of the ink cartridge 25 in FIGS. 3A to 3C. An ink supplying opening 62*a* formed at the tip of the ink supplying unit 62 is connected to the ink flow path 52 when the ink cartridge 25 is attached to the first cartridge attaching unit 5. The ink supplying unit 62 has an unillustrated valve. This valve is opened only when the ink cartridge 25 is attached to the first cartridge attaching unit 5, and the ink storage space 61 communicates with the ink supplying opening 62*a* when the valve is open. As a result the ink storage space 61 communicates with the ink flow path 52, and ink in the ink storage space 61 is supplied to the inkjet head 3 through the ink flow path 52 and the tube 6. In other words, the ink cartridge 25 is attached to the ink storage space 61, i.e. to the first cartridge attaching unit 5, in such a way that ink is supplied to the inkjet head.

The outside-air passage unit 63 is disposed in the vicinity of the upper end of the right-side wall of the ink cartridge 25 in FIGS. 3A to 3C. When the ink cartridge 25 is attached to the first cartridge attaching unit 5, a connection opening 63*a* formed at the tip of the outside-air passage unit 63 is connected to the air hole 53. The outside-air passage unit 63 has an unillustrated valve. This valve is opened only when the ink cartridge 25 is attached to the first cartridge attaching unit 5, and the connection opening 63*a* communicates with the air passage 65 when the valve is open.

The air passage 65 is disposed above the ink storage space 61 and obliquely ascends from left to right in FIG. 3A to FIG. 3C. The air passage 65 is connected to the ink storage space 61 at the leftmost part of FIG. 3A to FIG. 3C. Also, at the rightmost part of FIGS. 3A to 3C, the air passage 65 is connected to the lower end of the outside-air passage unit 63, which end is below the connection opening 63*a*. Therefore the outside-air passage unit 63 is connected to the ink storage space 61 via the air passage 65, and the ink storage space 61 communicates with the outside air. As ink flows out from the ink storage space 61 through the ink flow path 52, air is introduced into the ink storage space 61 through the outside-air passage unit 63 and the air passage 65, as much as the ink flowing out. It is noted that the air passage 65 is equivalent to an atmosphere passage of the present invention.

The rotating component 64 which is a detector is provided inside the ink storage space 61. The rotating component 64 is supported at a fulcrum 64*a* so as to be rotatable in clockwise and anticlockwise directions in FIGS. 3A to 3C. At the left hand end of the rotating component 64 in FIGS. 3A to 3C, a float 64*b* is provided. As the height of the liquid level in the ink storage space 61 changes (i.e. an amount of ink changes), the ink provides buoyancy to the float 64*b* so that the rotating component 64 rotates.

At the right hand end of the rotating component in FIG. 3, a light blocking section 64*c* which is a movable unit is provided. The position of this section 64*c* changes in accordance with the rotation of the rotating component 64. In the ink cartridge 25, a part which overlaps the light emitting unit 54 and the light receiving unit 55 in the direction perpendicular to the surface of each of FIGS. 3A to 3C, when the ink cartridge 25 is attached to the first cartridge attaching unit 5, is light-permeable, except in a later-detailed case where light is blocked by a blocking section 64*c*.

As illustrated in FIG. 3B, this light blocking section 64*c* is in first position to block laser light emitted from the light emitting unit 54, when an amount of ink in the ink cartridge 25 is not smaller than the aforesaid predetermined remaining amount. In this state the light receiving unit 55 does not receive laser light. On the other hand, when an amount of ink in the ink cartridge 25 is smaller than the predetermined remaining amount, the light blocking section 64*c* is in the second position not to block laser light emitted from the light emitting unit 54. In this state the light receiving unit 55 receives laser light emitted from the light emitting unit 54. It is therefore possible, by detecting whether the light receiving unit 55 receives laser light or not, to detect whether an amount of ink in the ink cartridge 25 attached to the first cartridge attaching unit 5 is smaller than the aforesaid predetermined remaining amount, i.e. to detect whether the ink cartridge 25 is in the empty state or not.

Back to FIGS. 1 and 2, the tube 6 connects the first cartridge attaching unit 5 with the inkjet head 3. The ink inside the ink cartridge 25 attached to the first cartridge attaching unit 5 is therefore supplied to the inkjet head 3 through the tube 6.

The suction cap 7 is disposed to face the carriage 2 when the carriage 2 is at the rightmost position in FIG. 1, which position is to the right of the sheet conveyance path 41. The suction cap 7 is connected to the upstream end of the ink discharge path. The suction cap 7 includes: a first cap unit 7*a* used to cover the nozzles 31 which constitute the leftmost nozzle string 32 in FIG. 1 and eject black ink; and a second cap unit 7*b* used to cover the nozzles 31 which constitute the second leftmost to the rightmost nozzle strings 32 in FIG. 1 and eject color inks, i.e. yellow, cyan, and magenta inks. In addition to the above, the suction cap 7 is arranged to be movable in the vertical directions in FIG. 2. This makes it possible to cover the corresponding nozzles 31 by the first and second cap units 7*a* and 7*b* by raising the suction cap 7 after the carriage 2 is moved to the position where the inkjet head 3 faces the suction cap 7.

The switching unit 8 is provided in the middle of the ink discharge path, and selectively connects at least one of the first cap unit 7*a* and the second cap unit 7*b* of the suction cap 7 with the pump 9. The pump 9 is disposed downstream of the switching unit 8 which is in the middle of the ink discharge path. The pump 9 is a known pump such as a tube pump. The pump 9 sucks ink from the inkjet head 3 through the nozzles 31, via the at least one of the first cap unit 7*a* and the second cap unit 7*b* with which the pump 9 is connected via the switching unit 8. The pump 9 then performs so-called suction purge, i.e. conveys the sucked ink toward the storage tank 10. Thickened portions of the ink and contaminants in the ink are removed from the inkjet head 3 as a result, and hence clogging of the nozzles 31 is prevented.

In the ink discharge path, the storage tank 10 is provided downstream of the pump 9 and between the pump 9 and the second cartridge attaching unit 13. The storage tank 10 is fixed to the printer 1 and not detachable therefrom. The storage tank 10 temporarily stores ink sucked from the inkjet head 3, i.e. ink ejected from the inkjet head 3 to the ink discharge path. The storage tank 10 has a connection hole 10*a* which is open to the outside air. The connection hole 10*a* is provided with a first valve 11. The first valve 11 switches the state of the storage tank 10 between open to the outside air and cutoff from the outside air. Provided in the vicinity of the storage tank 10 is a liquid level sensor 14 which can detect whether the liquid level of the ink in the storage tank 10 is higher than a predetermined height. This makes it possible to detect whether an amount of ink stored in the storage tank 10 is not smaller than a predetermined reference storage amount.

The second cartridge attaching unit 13 is connected to the downstream end of the ink discharge path. To/from this second cartridge attaching unit 13, a used ink cartridge 25 which is in the empty state as all ink therein has been consumed is attachable/detachable. Therefore an ink cartridge 25 attached to the second cartridge attaching unit 13 is connected to (communicates with) the downstream end of the ink discharge path. In this way, a used ink cartridge 25 is effectively recycled by attaching it to the second cartridge attaching unit 13. Ink in the ink discharge path is, as discussed later, ejected to the ink cartridge 25 attached second cartridge attaching unit 13.

Now, details of the second cartridge attaching unit 13 are given. It is noted that the description is given using FIG. 3 because the second cartridge attaching unit 13 is substantially identical with the first cartridge attaching unit 5. In FIG. 3, the numbers in parentheses relate to the second cartridge attaching unit 13.

The second cartridge attaching unit 13 includes a cartridge storage space 71, an ink flow path 72, an air hole 73, a light emitting unit 74 which is a first light emitting unit, a light receiving unit 75 which is a first light receiving unit, an attaching sensor 76, and a lid 77.

The cartridge storage space 71 is a space where a used ink cartridge 25 is inserted. This space 71 is arranged to be identical with the cartridge storage space 51. The ink flow path 72 is identical with the ink flow path 52, and the right hand end of the path 72 is connected to the storage tank 10. When an ink cartridge 25 is inserted into the cartridge storage space 71, the ink supplying opening 62*a* of the ink supplying unit 62 of the ink cartridge 25 is connected to the ink flow path 72 and the ink storage space 61 communicates the ink supplying opening 62*a* because an unillustrated valve of the ink supplying unit 62 is opened. Therefore the ink conveyed from the storage tank 10 to the downstream of the ink discharge path flows through the ink flow path 72 into the ink storage space 61 of the ink cartridge 25 inserted into the cartridge storage space 71. The air hole 73 is identical with the air hole 53 in terms of the structure. When the ink flows into the ink storage space 61, air is discharged to the outside from the ink storage space 61 through the air passage 65, the outside-air passage unit 63, and the air hole 73 as much as the ink flowing in.

Detailed descriptions of the light emitting unit 74, the light receiving unit 75, the attaching sensor 76, and the lid 77 are not given because they are identical with the light emitting unit 54, the light receiving unit 55, the attaching sensor 56, and the lid 57, respectively.

Back to FIGS. 1, 2, the second cartridge attaching unit 13 is disposed to the right of the sheet conveyance path 41 in the scanning directions, along with the suction cap 7, the switching unit 8, the pump 9, and the storage tank 10. In other words, with respect to the sheet conveyance path 41, the second cartridge attaching unit 13 is on the same side as the suction cap 7, the switching unit 8, the pump 9, and the storage tank 10. This results in the suction cap 7, the switching unit 8, the pump 9, the storage tank 10, and the second cartridge attaching unit 13 being close to one another, and hence the later-detailed conveyance of ink on the ink discharge path is easily done.

Between the storage tank 10 and the second cartridge attaching unit 13, disposed is a second valve 12. The second valve 12 switches the state of the storage tank 10 between connection to and cutoff from the second cartridge attaching unit 13.

In the printer 1, the pump 9 is driven while the aforesaid first valve 11 does not cut off the storage tank 10 from the outside air whereas the second valve 12 cuts off the storage tank 10 from the second cartridge attaching unit 13. With this, ink in the inkjet head 3 is sucked through the nozzles 31 and conveyed to the storage tank 10 (first conveyance mode).

On the other hand, the pump 9 is driven while the first valve 11 cuts off the storage tank 10 from the outside air whereas the second valve 12 does not cut off the storage tank 10 from the second cartridge attaching unit 13. With this, ink stored in the storage tank 10 is conveyed to the ink cartridge 25 attached to the second cartridge attaching unit 13 (second conveyance mode).

In this way, in the present embodiment the pump 9 functions not only as a power source for sucking ink from the inkjet head 3 through the nozzles 31 and conveying the same to the storage tank 10 but also a power source for conveying ink stored in the storage tank 10 to the ink cartridge 25 attached to the second cartridge attaching unit 13.

Therefore it is unnecessary to provide different power sources and hence the structure of the printer 1 is kept simple. In addition to the above, the aforesaid first and second conveyance modes are easily switchable by (i) switching the state of the storage tank 10 between connection to and cut off from the outside air by the first valve 11 and (ii) switching, by the second valve 12, the state of the storage tank 10 between connection to and cut off from the second cartridge attaching unit 13.

Figure 4:
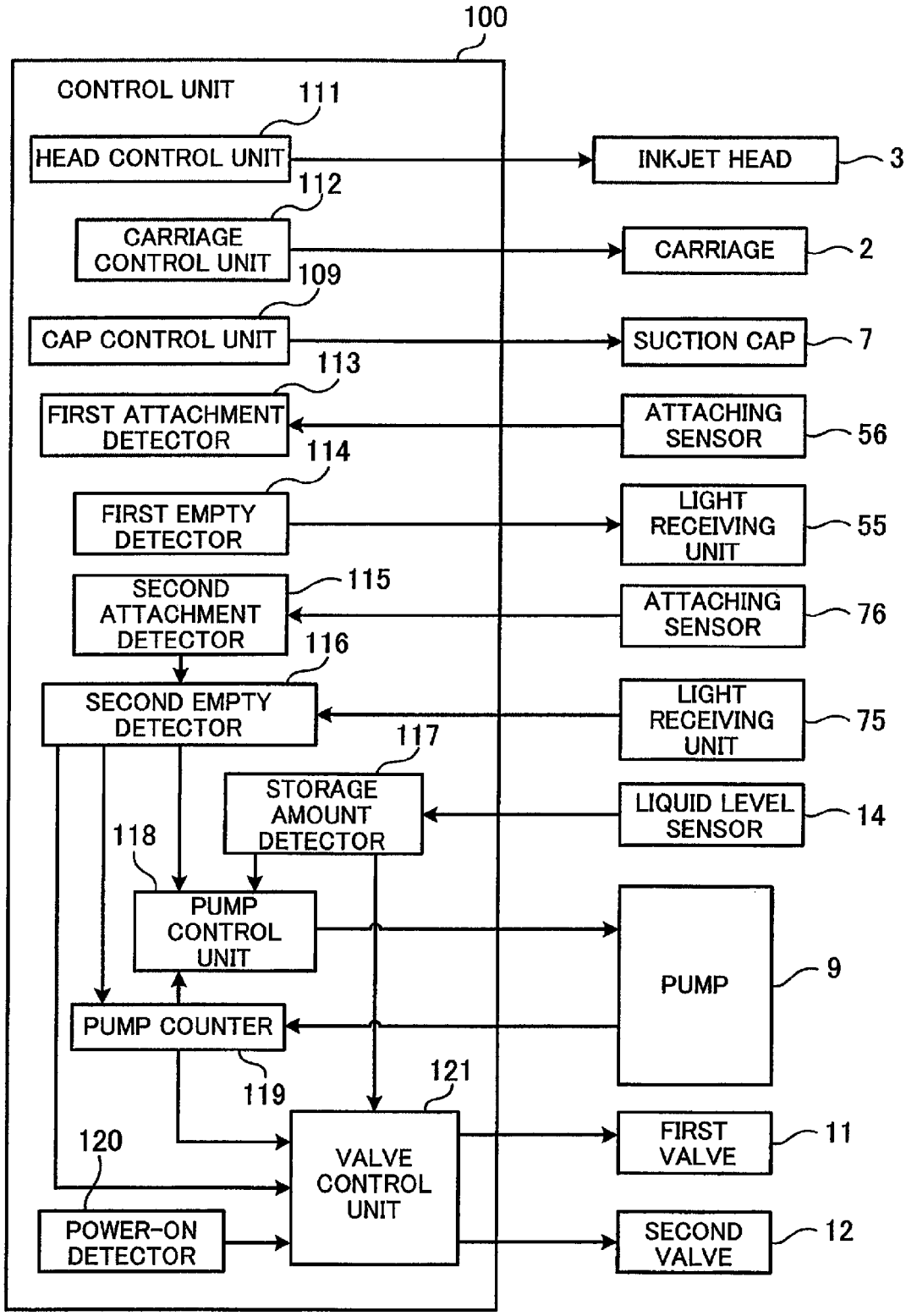
FIG. 4 is a block diagram of the control unit of FIG. 1.

The following describes the control unit 100 which controls the operation of the printer 1. FIG. 4 is a block diagram of the control unit 100 of FIG. 1.

The control unit 100 is constituted by components such as a CPU (Central Processing Unit), a ROM (Read only Memory), and a RAM (Random Access Memory). As shown in FIG. 4, these components function as a head control unit 111, a carriage control unit 112, a cap control unit 109, a first attachment detector 113, a first empty detector 114, a second attachment detector 115, a second empty detector 116, a storage amount detector 117, a pump control unit 118, a pump counter 119, a power-on detector 120, and a valve control unit 121.

The head control unit 111 controls the operation of the inkjet head 3 when it ejects ink from the nozzles 31. The carriage control unit 112 controls the movement of the carriage 2. The cap control unit 109 controls the vertical movement of the suction cap 7. The first attachment detector 113 detects whether an ink cartridge 25 is attached to the first cartridge attaching unit 5 by detecting whether the lever 56*a* of the attaching sensor 56 is lifted up by the ink cartridge 25.

When the first attachment detector 113 has detected that an ink cartridge 25 is attached to the first cartridge attaching unit 5, the first empty detector 114 detects whether that ink cartridge is in the empty state by detecting whether the light receiving unit 55 receives laser light. It is noted that the first empty detector 114, the light emitting unit 54, and the light receiving unit 55 are equivalent to the first empty detector of the present invention.

The second attachment detector 115 detects whether an ink cartridge 25 is attached to the second cartridge attaching unit 13 by detecting whether the lever 76*a* of the attaching sensor 76 is lifted up by the ink cartridge 25. It is noted that a combination of the second attachment detector 115 and the attaching sensor 76 is equivalent to the attachment detector of the present invention.

When the second attachment detector 115 has detected that an ink cartridge 25 is attached to the second cartridge attaching unit 13, the second empty detector 116 detects whether that ink cartridge 25 is in the empty state by detecting whether the light receiving unit 75 receives laser light. It is noted that a combination of the second empty detector 116, the light emitting unit 74, and the light receiving unit 75 is equivalent to the second empty detector of the present invention.

The storage amount detector 117 detects whether an amount of ink stored in the storage tank 10 is not smaller than a reference storage amount by causing the liquid level sensor 14 to detect whether the liquid level of the ink in the storage tank 10 is at a predetermined height or higher. It is noted that a combination of the liquid level sensor 14 and the storage amount detector 117 is equivalent to the liquid amount detector of the present invention.

The pump control unit 118 controls the operation of the pump 9. The pump counter 119 counts how many times the pump 9 is driven. The power-on detector 120 detects whether the printer 1 is powered on. The valve control unit 121 controls the operations of the first valve 11 and the second valve 12.

Figure 5:
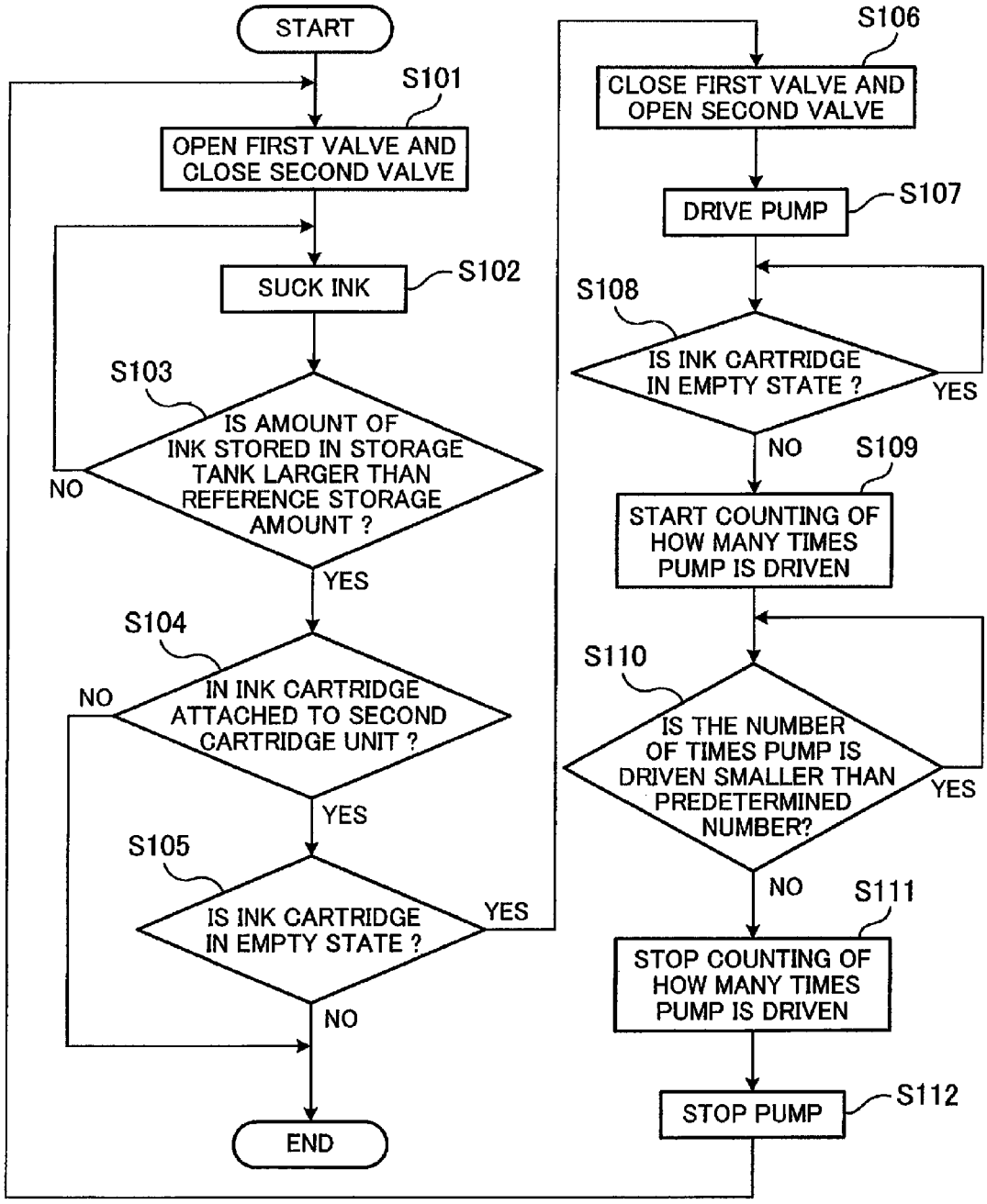
FIG. 5 is a flowchart of a process to suck ink from the inkjet head, convey the ink to the storage tank and further convey the ink to the ink cartridge attached to the second cartridge attaching unit.
Figure 6:
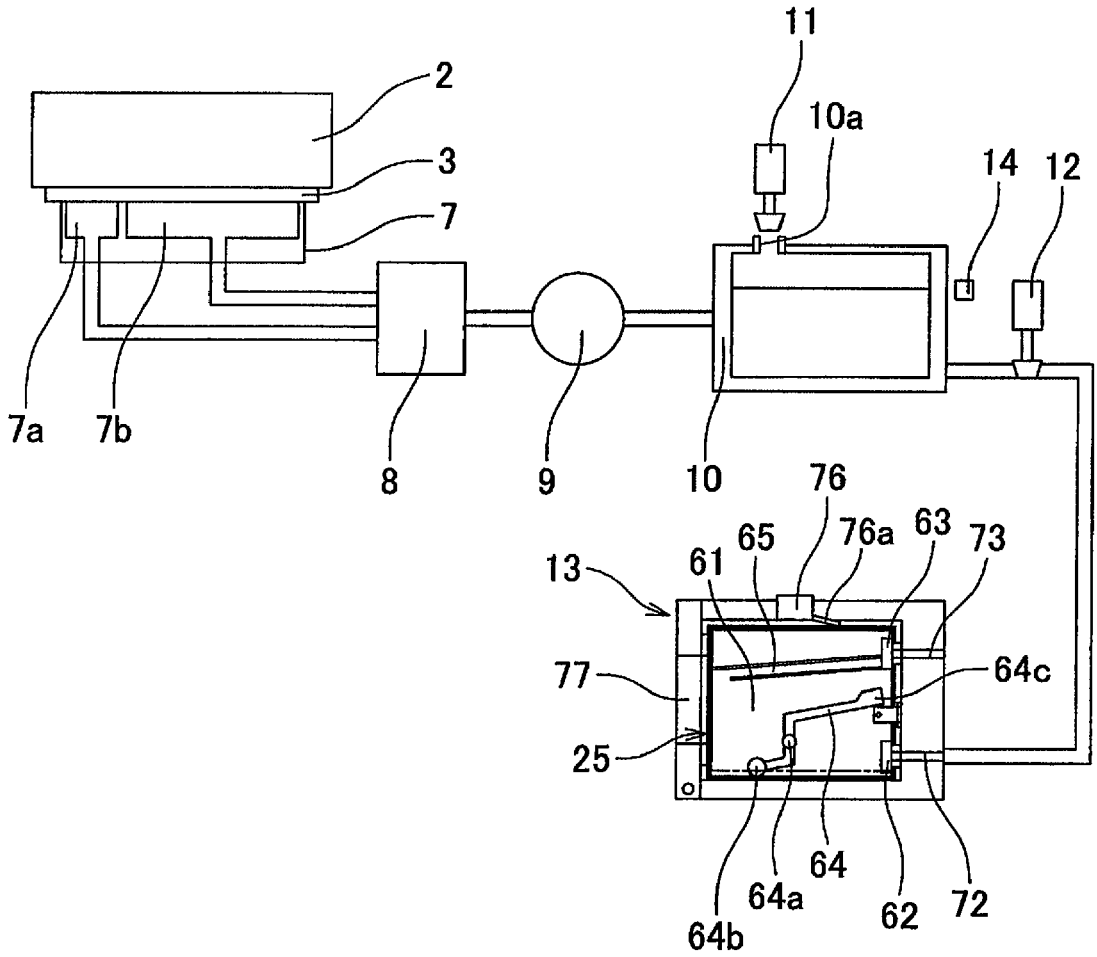
FIG. 6 is equivalent to FIG. 2 and shows a case where ink is sucked from the inkjet head and conveyed to the storage tank.
Figure 7:
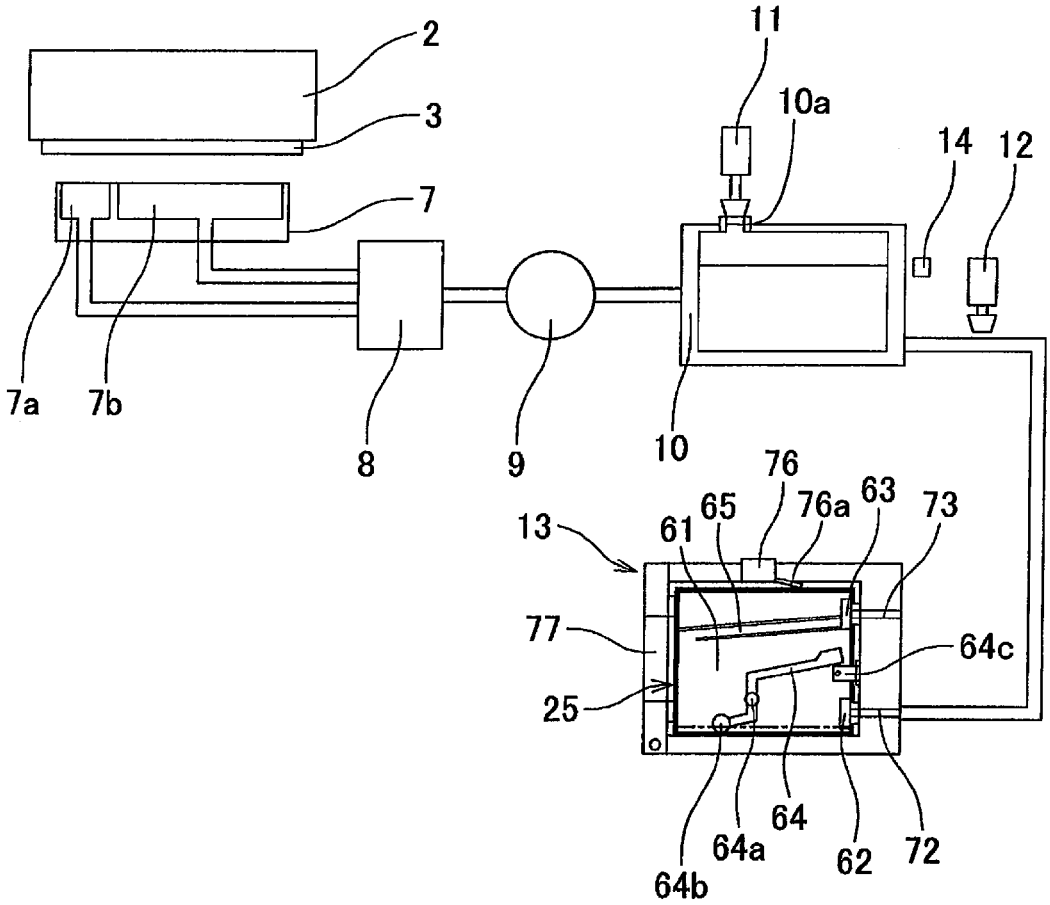
FIG. 7 is equivalent to FIG. 2 and shows a case where ink is conveyed from the storage tank to the ink cartridge attached to the second cartridge attaching unit.
Figure 8A:
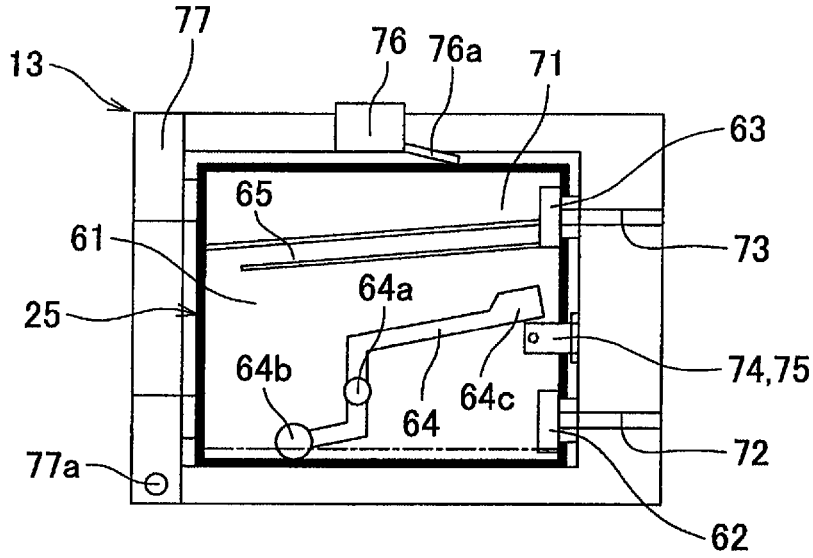
FIG. 8A shows the ink cartridge attached to the second cartridge attaching unit during the operation illustrated in FIG. 5.
Figure 8B:
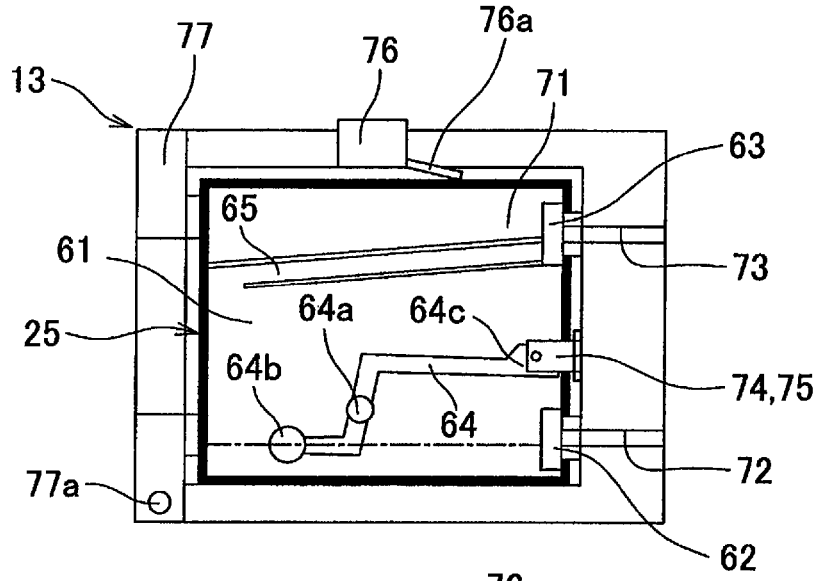
FIG. 8B shows the ink cartridge attached to the second cartridge attaching unit during the operation illustrated in FIG. 5.
Figure 8C:
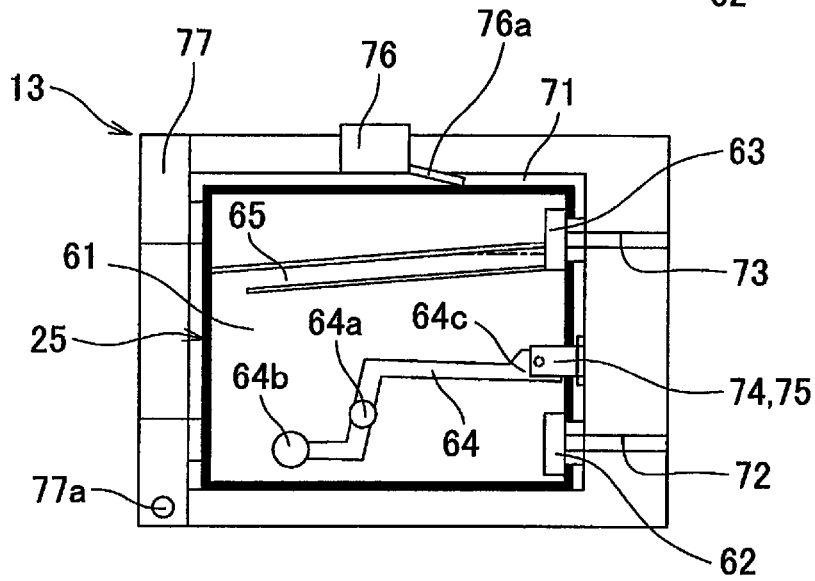
FIG. 8C shows the ink cartridge attached to the second cartridge attaching unit during the operation illustrated in FIG. 5.

Now, described with reference to the flow chart of FIG. 5 and FIG. 2, FIG. 6, FIG. 7, and FIG. 8A to FIG. 8C are the operations of the printer 1 of the present embodiment, which are the operation to suck ink in the inkjet head 3 through the nozzles 31 and convey the ink to the storage tank 10 and the operation to convey ink stored in the storage tank 10 to the ink cartridge 25 attached to the second cartridge attaching unit 13. FIG. 5 is a flowchart of the aforesaid operations of the printer 1. FIG. 6 is equivalent to FIG. 2 and shows a case where ink is sucked from the inkjet head 3 through the nozzles 31 and conveyed to the storage tank 10. FIG. 7 is equivalent to FIG. 2 and shows a case where ink is conveyed from the storage tank 10 to the ink cartridge 25 attached to the second cartridge attaching unit 13. FIGS. 8A to 8C show the second cartridge attaching unit 13 and the ink cartridge 25 attached to the second cartridge attaching unit 13, during the aforesaid operations.

As illustrated in FIG. 2, when power is off, the printer 1 is arranged such that the first valve 11 cuts off the storage tank 10 from the outside air and the second valve 12 cuts off the storage tank 10 from the second cartridge attaching unit 13. This prevents ink from overflowing from the storage tank 10. The operations illustrated in the flowchart of FIG. 5 start when the printer 1 is powered on.

As illustrated in FIG. 5, when the printer 1 is powered on, the first valve 11 stops cutting off the storage tank 10 from the outside air under the control of the valve control unit 121, as illustrated in FIG. 6 (step S101, hereinafter referred to simply as S101, for example). At this point, the second valve 12 is kept to cut off the storage tank 10 from the second cartridge attaching unit 13.

Subsequently, when it is necessary to suck ink from the inkjet head 3 because of reasons such as poor ejection of ink from the nozzles 31, the carriage 2 is moved under the control of the carriage control unit 112 to the position where the inkjet head 3 opposes the suction cap 7, and then the suction cap 7 is moved up so as to cover the nozzles 31, under the control of the cap control unit 109. In this condition, the pump control unit 118 drives the pump 9. Thickened portions of the ink and contaminants in the ink are sucked through the nozzles 31 from the inkjet head 3 as a result, and the sucked matter is conveyed to the storage tank 10. (S102). The ink conveyed to the storage tank 10 is stored therein.

It is noted that the storage tank 10 is provided in the present embodiment, and hence it is possible to suck ink from the inkjet head 3 and convey the sucked ink to the storage tank 10 as in the aforesaid S102, even when the conveyance of ink to the ink cartridge 25 attached to the second cartridge attaching unit 13 is impossible because, for example, no ink cartridge 25 is attached to the second cartridge attaching unit 13 or an amount of a liquid in the ink cartridge 25 of the second cartridge attaching unit 13 has reached the capacity. Therefore ink is efficiently sucked from the inkjet head 3.

Until an amount of ink stored in the storage tank 10 becomes equal to or larger than a reference storage amount (S103: NO), the step S102 is repeated. When the storage amount detector 117 detects that an amount of ink stored in the storage tank 10 is equal to or larger than the reference storage amount (S103: YES), the second attachment detector 115 detects whether an ink cartridge 25 is attached to the second cartridge attaching unit 13 (S104). If no ink cartridge 25 is attached (S104: NO), a warning is given for example and the operation is stopped.

Therefore the operation of conveying ink from the storage tank 10 to the ink cartridge 25 attached to the second cartridge attaching unit 13, i.e. later-detailed S106 to S112 is not carried out when no ink cartridge 25 is attached to the second cartridge attaching unit 13. This prevents ink from overflowing from the second cartridge attaching unit 13 to which no ink cartridge 25 is attached.

On the other hand, when an ink cartridge 25 is attached to the second cartridge attaching unit 13 (S104: YES), the second empty detector 116 detects whether that ink cartridge 25 is in the empty state (S105). If the attached ink cartridge 25 is not in the empty state (S105: NO), a warning is given for example and the operation is stopped.

Therefore the operation of conveying ink from the storage tank 10 to the ink cartridge 25 attached to the second cartridge attaching unit 13, i.e. later-detailed S106 to S112 is not carried out when the ink cartridge 25 attached to the second cartridge attaching unit 13 is not in the empty state. This prevents ink from overflowing from the ink cartridge 25 attached to the second cartridge attaching unit.

In the meanwhile, when as illustrated in FIG. 8A the ink cartridge 25 attached to the second cartridge attaching unit 13 is in the empty state (S105: YES), as illustrated in FIG. 7, the first valve 11 cuts off the storage tank 10 from the outside air and the second valve 12 stops cutting off the storage tank 10 from the second cartridge attaching unit 13, under the control of the valve control unit 121 (S106), and then the pump control unit 118 drives the pump 9 (S107). This results in conveying the ink in the storage tank 10 to the ink cartridge 25 attached to the second cartridge attaching unit 13, and hence an amount of ink in this ink cartridge 25 is increased. It is noted that an discharge possible state is established in the present invention when the second attachment detector 115 has detected that an ink cartridge 25 is attached to the second cartridge attaching unit 13 and the second empty detector 116 has detected that the attached cartridge is in the empty state (i.e. S105: YES and S106: YES).

Thereafter, until the second empty detector 116 detects that the ink in the ink cartridge 25 attached to the second cartridge attaching unit 13 has increased and the ink cartridge 25 is no longer in the empty state (S108: YES), the conveyance of the ink from the storage tank 10 to the ink cartridge 25 attached to the second cartridge attaching unit 13 is continued. Subsequently, as illustrated in FIG. 8B, when the second empty detector 116 detects that an amount of ink in the ink cartridge 25 attached to the second cartridge attaching unit 13 has increased to the predetermined remaining amount and the ink cartridge 25 is no longer in the empty state (S108: NO), the pump counter 119 starts to count how many times the pump 9 is driven (S109).

Until the number of times the pump 9 is driven, which is counted by the pump counter 119, reaches a predetermined number (S110: YES), the conveyance of the ink from the storage tank 10 to the ink cartridge 25 attached to the second cartridge attaching unit 13 is continued. When the number of times the pump 9 is driven counted by the pump counter 119 reaches the predetermined number (S110: NO), the pump counter 119 stops the counting of how many times the pump 9 is driven (S111) and the pump 9 is stopped (S112) so that the conveyance of the ink from the storage tank 10 to the ink cartridge 25 attached to the second cartridge attaching unit 13 is discontinued. Thereafter the process returns to the aforesaid S101.

In regard to the conveyance of ink from the storage tank 10 to the ink cartridge 25 attached to the second cartridge attaching unit 13, an amount of ink conveyed by driving the pump 9 once is more or less constant. Therefore, a predetermined conveyance amount of ink is conveyed to the ink cartridge 25 attached to the second cartridge attaching unit 13 when the pump 9 is driven a predetermined number of times after ink is conveyed to the ink cartridge 25 until it becomes no longer in the empty state.

The predetermined conveyance amount of ink is larger than a result of subtracting the aforesaid predetermined remaining amount from the capacity of the ink storage space 61 and is smaller than a result of subtracting the aforesaid predetermined remaining amount from the total of the capacity of the ink storage space 61 and the capacity of the air passage 65 which is an atmosphere passage. As a result, in the ink cartridge 25 attached to the second cartridge attaching unit 13, ink is conveyed not only to the ink storage space 61 but also to the air passage 65 in the end, as shown in FIG. 8C.

The ink cartridge 25 containing ink therein is kept attached to the first cartridge attaching unit 5 for a long period of time. In this regard, to prevent the ink from overflowing through the connection opening 63*a* due to reasons such as the shaking of the printer 1, the ink is typically stored only in the ink storage space 61 and no ink is stored in the air passage 65 when the printer 1 is shipped.

On the other hand, because the ink cartridge 25 attached to the second cartridge attaching unit 13 is detached from the second cartridge attaching unit 13 and disposed of after the conveyance of ink thereto is completed, the ink cartridge 25 containing ink therein is not kept attached to the second cartridge attaching unit 13 for a long period of time, and hence it is unnecessary in this case to give a high priority to the problem of the overflow of ink through the connection opening 63*a*. For this reason a large amount of ink can be conveyed from the storage tank 10 when the ink is conveyed not only to the ink storage space 61 of the ink cartridge 25 attached to the second cartridge attaching unit 13 but also to the air passage 65 connected to the ink storage space 61.

It is noted that, as discussed above, the connection opening 63*a* of the outside-air passage unit 63 is disposed above the air passage 65, and hence ink does not overflow through the connection opening 63*a* when the ink cartridge 25 is attached to the second cartridge attaching unit 13.

In addition to the above, the present embodiment is arranged so that the conveyance of ink from the storage tank 10 to the ink cartridge 25 attached to the second cartridge attaching unit 13 is carried out only when an amount of ink in the storage tank 10 becomes not smaller than the aforesaid reference storage amount (S103: YES). Therefore the pump 9 is not driven, i.e. the conveyance of ink is not performed, when the storage tank 10 scarcely stores ink, and hence an amount of ink to be conveyed as a result of one drive of the pump 9 is more or less constant with certainty. This ensures the conveyance of the aforesaid predetermined conveyance amount of ink from the storage tank 10 to the ink cartridge 25 attached to the second cartridge attaching unit 13.

As discussed above, in the embodiment an amount of ink conveyed from the storage tank 10 to the ink cartridge 25 attached to the second cartridge attaching unit 13 is adjusted using the light emitting unit 74, the light receiving unit 75, and the second empty detector 116 which are provided to detect whether the ink cartridge 25 is in the empty state. It is therefore unnecessary to additionally provide a dedicated mechanism for adjusting an amount of ink conveyed to the ink cartridge 25 and hence the structure of the printer 1 is kept simple.

Back to S101, an amount of the ink in the storage tank 10 is smaller than the reference storage amount because the ink has been conveyed from the storage tank 10 to the ink cartridge 25 attached to the second cartridge attaching unit 13 as a result of the above-described S106 to S110. The printer 1 can therefore suck the ink from the inkjet head 3 through the nozzles 31 and convey the sucked ink to the storage tank 10, by performing the above-described S101 to S103.

In addition to the above, in case where the ink cartridge 25 attached to the second cartridge attaching unit 13 is replaced with another ink cartridge 25 which is a used cartridge, when an amount of ink in the storage tank 10 becomes equal to or larger than the reference storage amount in the above-described S103 (S103: YES), it is detected in the above-described S104 that the ink cartridge 25 is attached to the second cartridge attaching unit 13 (S104: YES) and it is detected in S105 that the ink cartridge 25 is in the empty state (S105: YES). In other words, it is detected that the discharge possible state is established. Thereafter the above-described S106 to S112 are carried out.

On the other hand, when the ink cartridge 25 attached to the second cartridge attaching unit 13 has not been replaced, i.e. when it has not been detected that the discharge possible state is recovered (S105: NO), the conveyance of ink from the storage tank 10 to the ink cartridge 25 attached to the second cartridge attaching unit 13 is not carried out.

In this way, it becomes possible to continue the operation of sucking ink from the inkjet head 3 and conveying the ink to the storage tank 10 when the ink cartridge 25 attached to the second cartridge attaching unit 13 is replaced with another ink cartridge 25 and ink is conveyed from the storage tank 10 to the new ink cartridge 25 attached to the second cartridge attaching unit 13. This elongates the life of the printer 1.

In addition to the above, the printer 1 is arranged so that the power-on detector 120 detects that the printer 1 is powered off. When power-off is detected, the valve control unit 121 causes the first valve 11 to cut off the storage tank 10 from the outside air and causes the second valve to cut off the storage tank 10 from the second cartridge attaching unit 13. This prevents ink from overflowing from the storage tank 10 when the printer 1 is powered off. As a matter of course, if the printer 1 is powered off in the midst of the operation of FIG. 5, the operation of FIG. 5 is discontinued and the aforesaid blocking operation is carried out by the first valve 11 and the second valve 12.

According to the embodiment above, the ink sucked from the inkjet head 3 and conveyed to the storage tank 10 is further conveyed to the ink cartridge 25 attached to the second cartridge attaching unit 13. It is therefore possible to continue the sucking of ink from the inkjet head 3 after the ink cartridge 25 attached to the second cartridge attaching unit 13 is replaced with another one, thereby elongating the life of the printer 1.

In addition, after the ink cartridge 25 attached to the second cartridge attaching unit 13 becomes no longer in the empty state, a predetermined conveyance amount of ink is further conveyed to the ink cartridge 25, and this predetermined conveyance amount is larger than a result of subtracting a predetermined remaining amount from the capacity of the ink storage space 61 and smaller than a result of subtracting the predetermined remaining amount from the total of the capacity of the ink storage space 61 and the capacity of the air passage 65. Therefore, in the ink cartridge 25 attached to the second cartridge attaching unit 13, ink is conveyed not only to the ink storage space 61 but also to the air passage 65 in the end.

The ink cartridge 25 containing ink therein is kept attached to the first cartridge attaching unit 5 for a long period of time. In this regard, to prevent the ink from overflowing through the connection opening 63*a* due to reasons such as the shaking of the printer 1, the ink is typically stored only in the ink storage space 61 and no ink is stored in the air passage 65 when the printer 1 is shipped.

On the other hand, because the ink cartridge 25 attached to the second cartridge attaching unit 13 is detached from the second cartridge attaching unit 13 and disposed of after the conveyance of ink thereto is completed, the ink cartridge 25 containing ink therein is not kept attached to the second cartridge attaching unit 13 for a long period of time, and hence it is unnecessary in this case to give a high priority to the problem of the overflow of ink through the connection opening 63*a*. For this reason a large amount of ink can be conveyed from the storage tank 10 when the aforesaid predetermined conveyance amount is arranged as described above and the ink is conveyed not only to the ink storage space 61 but also to the air passage 65.

Subsequently, the conveyance of ink to the ink cartridge 25 attached to the second cartridge attaching unit 13 is stopped until the ink cartridge 25 attached to the second cartridge attaching unit 13 is replaced to another one and the aforesaid discharge possible state is recovered. This prevents ink from overflowing from the ink cartridge 25.

Furthermore, as discussed above, an amount of ink conveyed to the ink cartridge 25 attached to the second cartridge attaching unit 13 is adjusted using the light emitting unit 74, the light receiving unit 75, and the second empty detector 116 which are provided to detect whether the ink cartridge 25 attached to the second cartridge attaching unit 13 is in the empty state. It is therefore unnecessary to additionally provide a dedicated mechanism for adjusting an amount of ink conveyed to the ink cartridge 25 and hence the structure of the printer 1 is kept simple.

In addition to the above, the first cartridge attaching unit 5 is provided with the light emitting unit 54 and the light receiving unit 55, the second cartridge attaching unit 13 is provided with the light emitting unit 74 and the light receiving unit 75, and the ink cartridge 25 is provided with the rotating component 64 which has the light blocking section 64*c* and rotates in response to a change in a remaining amount of ink in the ink storage space 61. it is therefore possible to easily construct a first empty detector and a second empty detector which can detect whether the ink cartridges 25 attached to the first cartridge attaching unit 5 and the second cartridge attaching unit 13, respectively, are in the empty state or not by detecting whether the light receiving units 55 and 75 receive laser light.

Furthermore, since ink sucked from the inkjet head 3 through the nozzles 31 is conveyed to the storage tank 10, it is possible to store the ink in the storage tank 10 on condition that the tank 10 has an available space, even when, for example, no ink cartridge 25 is attached to the second cartridge attaching unit 13 or the ink cartridge 25 attached to the second cartridge attaching unit 13 does not have an available space. This makes it possible to efficiently suck ink from the inkjet head 3.

Furthermore, since ink is conveyed from the storage tank 10 to the ink cartridge 25 attached to the second cartridge attaching unit 13 only when an amount of ink in the storage tank 10 becomes not smaller than the reference storage amount, the conveyance of ink from the storage tank 10 to the ink cartridge 25 attached to the second cartridge attaching unit 13 is not carried out when, for example, the storage tank 10 scarcely stores ink. This makes it possible to efficiently convey ink to the ink cartridge 25.

Furthermore, in the present embodiment, ink is conveyed by driving the pump 9 predetermined number of times corresponding to a predetermined conveyance amount of ink. In this regard, the transportation of ink to the ink cartridge 25 attached to the second cartridge attaching unit 13 is carried out only when the ink stored in the storage tank 10 is equal to or larger than the reference storage amount. Therefore an amount of ink to be conveyed by driving the pump 9 is more or less constant, and hence the predetermined conveyance amount of ink is surely conveyed.

In addition to the above, ink does not overflow from the second cartridge attaching unit 13 because the conveyance of ink from the storage tank 10 to the ink cartridge 25 attached to the second cartridge attaching unit 13 is not carried out when no ink cartridge 25 is attached to the second cartridge attaching unit 13 or when the ink cartridge 25 attached to the second cartridge attaching unit 13 is not in the empty state.

The following discusses variations in each of which various modifications are made to the embodiment above. It is noted that the same structural elements as those explained in the embodiment above will be assigned with the same reference numerals and the detailed explanations thereof will be suitably omitted.

Figure 9:
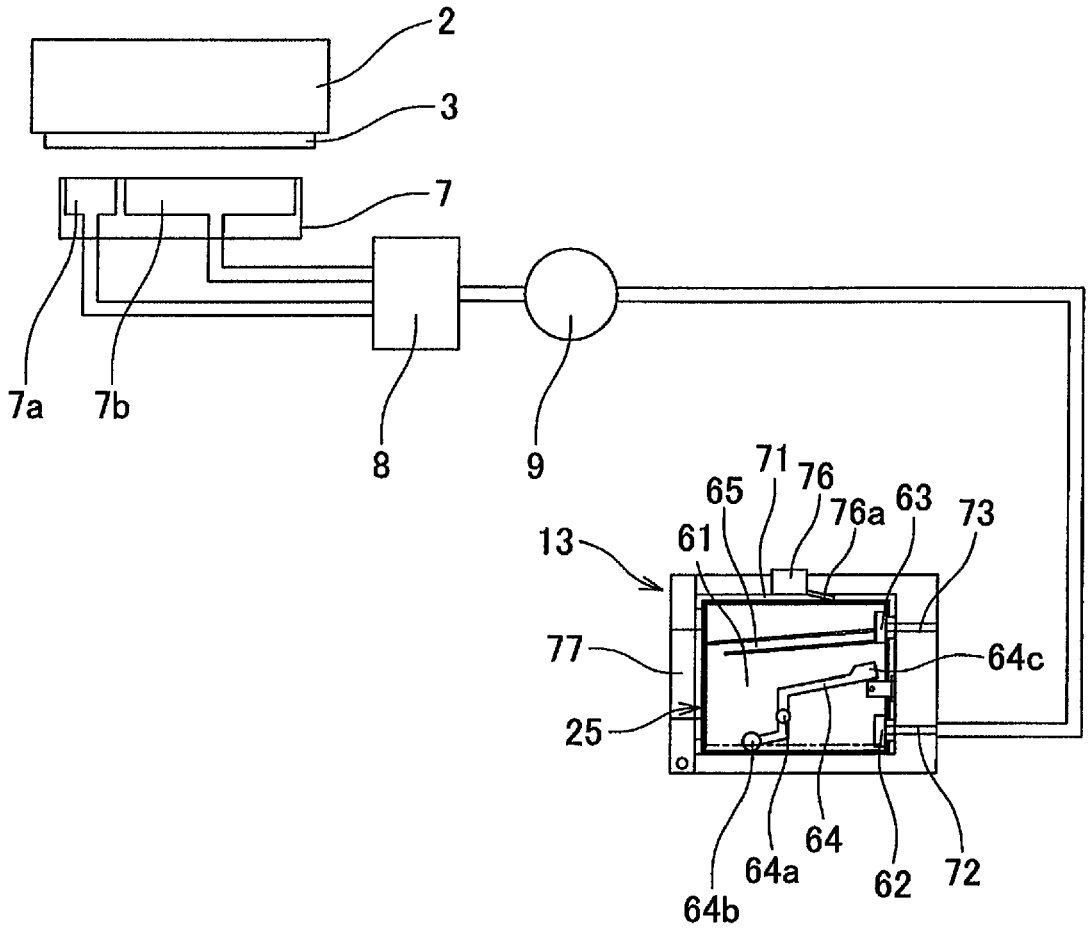
FIG. 9 relates to a variation 1 and is equivalent to FIG. 2.

In one variation, as illustrated in FIG. 9, no storage tank 10 is disposed between the pump 9 and the second cartridge attaching unit 13 and hence ink sucked from the inkjet head 3 through the nozzles 31 and the suction cap 7 is directly conveyed to the ink cartridge 25 attached to the second cartridge attaching unit 13 (variation 1).

Also in this case, a predetermined conveyance amount of ink is conveyed to the ink cartridge 25 attached to the second cartridge attaching unit 13 after the ink cartridge 25 becomes no longer in the empty state, i.e. after it is detected that the ink cartridge 25 is no longer in the empty state. Therefore ink does not overflow from the ink cartridge 25.

In this case, however, an amount of ink sucked as a result of the drive of the pump 9 varies in accordance with the condition of the inkjet head 3. In view of this, for example, how many times the pump 9 is driven after the ink cartridge 25 attached to the second cartridge attaching unit 13 becomes no longer in the empty state is detected with the assumption that an amount of ink sucked as a result of the drive of the pump 9 is equal to the maximum suckable amount. The overflow of ink from the ink cartridge 25 is surely prevented by this arrangement, because an amount of ink conveyed to the ink cartridge 25 after the ink cartridge 25 becomes no longer in the empty state is smaller than the aforesaid predetermined conveyance amount of ink.

In addition to the above, the aforesaid embodiment is arranged so that, after the ink cartridge 25 attached to the second cartridge attaching unit 13 becomes no longer in the empty state, the pump 9 is driven a predetermined number of times so that a predetermined conveyance amount of ink is further conveyed to the ink cartridge 25. The present invention, however, is not limited to this arrangement. For example, the printer 1 may be arranged so that, after the ink cartridge 25 attached to the second cartridge attaching unit 13 becomes no longer in the empty state, a predetermined conveyance amount of ink is further conveyed to the ink cartridge 25 by a method different from the above, for example by driving the pump 9 for a predetermined period of time.

Figure 10A:
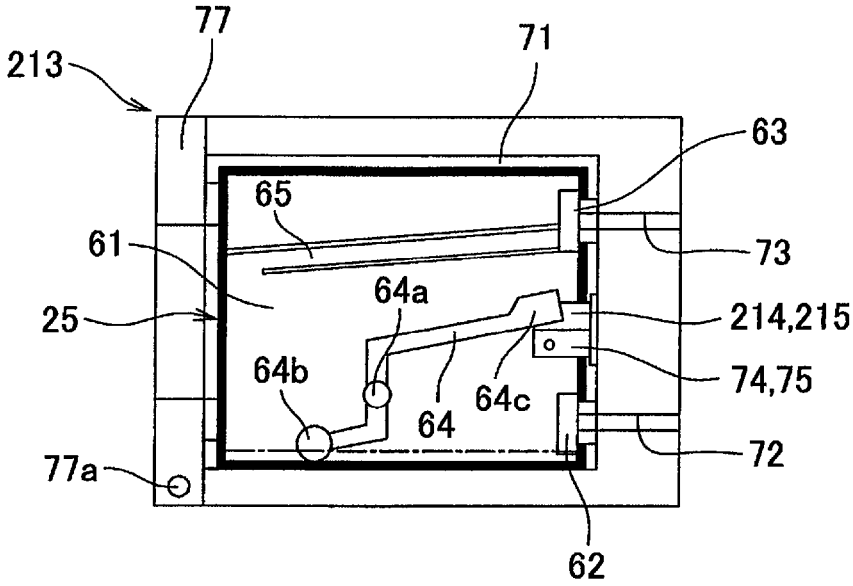
FIG. 10A relates to a variation 2 and is equivalent to FIG. 3B.
Figure 10B:
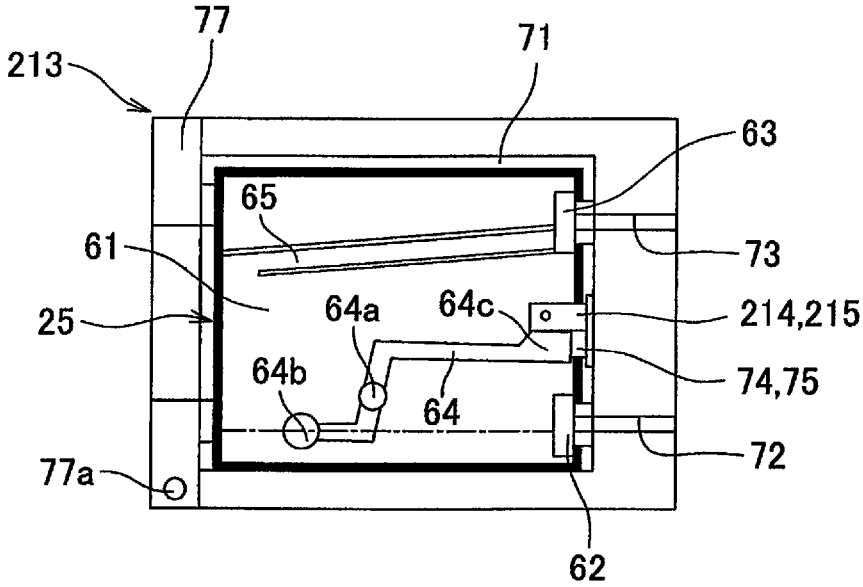
FIG. 10B relates to a variation 2 and is equivalent to FIG. 3C.

In addition to the above, although in the embodiment above whether an ink cartridge 25 is attached to the second cartridge attaching unit 13 is detected by using the attaching sensor 76, the present invention is not limited to this arrangement. In another variation, as illustrated in FIG. 10A and FIG. 10B, a second cartridge attaching unit 213 is arranged such that, in place of the attaching sensor 76 (see FIG. 3), a light emitting unit 214 which is a second light emitting unit and a light receiving unit 215 which is a second light receiving unit are disposed to oppose each other over the cartridge storage space 71, above the light emitting unit 74 and the light receiving unit 75. The light emitting unit 214 is identical with the light emitting unit 74 in terms of the structure and emits laser light toward the light receiving unit 215. The light receiving unit 215 is identical with the light receiving unit 75 in terms of the structure and receives laser light emitted from the light emitting unit 214. The light emitting unit 214 and the light receiving unit 215 are positioned so that the laser light emitted from the light emitting unit 214 is blocked by the light blocking section 64*c* of the rotating component 64 when the ink cartridge 25 attached to the second cartridge attaching unit 13 becomes in the empty state and the light blocking section 64*c* is positioned not to block the laser light emitted from the light emitting unit 74 (i.e. the light blocking section 64*c* is in the second position) (the variation 2).

In this variation, after an ink cartridge 25 is attached to the second cartridge attaching unit 13, the light receiving unit 215 does not receive laser light if the ink cartridge 25 is in the empty state, whereas the light receiving unit 75 does not receive laser light when the ink cartridge 25 is not in the empty state. Therefore, in this variation the second attachment detector 115 detects whether an ink cartridge 25 is attached to the second cartridge attaching unit 13 by detecting which one of the light receiving units, 75 or 215, does not receive laser light. It is noted that the light emitting units 54 and 214, the light receiving units 75 and 215, and the second attachment detector 115 of the variation 2 are equivalent to the attachment detector of the present invention.

In the variation, furthermore, the light emitting unit 74 and the light receiving unit 75, which constitute the second empty detector of the present invention provided for detecting whether an ink cartridge 25 attached to the second cartridge attaching unit 13 is in the empty state, are used as parts of the attachment detector of the present invention provided for detecting whether an ink cartridge 25 is attached to the second cartridge attaching unit 13. For this reason the attachment detector can be easily formed. It is noted that, in the first cartridge attaching unit 5, a light emitting unit and light receiving unit identical with the light emitting unit 214 and light receiving unit 215, respectively, may be provided in place of the attaching sensor 56 (see FIG. 3).

In the embodiment above, it is detected that the ink cartridges 25 attached to the first cartridge attaching unit 5 and the second cartridge attaching unit 13 are not in the empty state when it is detected that the light receiving units 55 and 75 do not receive laser light, and it is detected that the ink cartridges 25 attached to the first cartridge attaching unit 5 and the second cartridge attaching unit 13 are in the empty state when it is detected that the light receiving units 55 and 75 receive laser light. The present invention, however, is not limited to this.

For example, the present invention may be adapted so that the light emitting units 54 and 74 and the light receiving units 55 and 75 are positioned higher than those of the embodiment above, and contrary to the embodiment above, it is detected that the ink cartridges 25 attached to the first cartridge attaching unit 5 and the second cartridge attaching unit 13 are not in the empty state when it is detected that the light receiving units 55 and 75 receive laser light, and it is detected that the ink cartridges 25 attached to the first cartridge attaching unit 5 and the second cartridge attaching unit 13 are in the empty state when it is detected that the light receiving units 55 and 75 receive laser light.

Furthermore, the present invention is not limited to the embodiment above in which whether each of the ink cartridges 25 attached to the first cartridge attaching unit 5 and the second cartridge attaching unit 13 is in the empty state is detected by detecting whether laser light emitted from the light emitting unit 54 or 74 is blocked by the light blocking section 64*c* of the rotating component 64 in the ink cartridge 25. In this regard, the present invention may be adapted so that the laser light emitted from the light emitting unit 54 or 74 is blocked by a movable unit which is different from the light blocking section 64*c* of the rotating component 64 and moves in accordance with changes in the remaining amount of ink in the ink storage space 61, for example a float floating on the liquid surface of ink is provided in the ink storage space 61 and the float is configured to be able to block the laser light emitted from the light emitting unit 54 or 74.

In addition to the above, the present invention is not limited to the arrangement in which whether an ink cartridge is in the empty state is detected by detecting whether laser light emitted from the light emitting unit 54 or 74 is blocked by the movable unit. The present invention may be adapted so that the position of the movable unit is detected by a method different from the detection of whether or not laser light is blocked, and whether an ink cartridge is in the empty state is detected in accordance with the detected position of the movable unit.

Figure 11A:
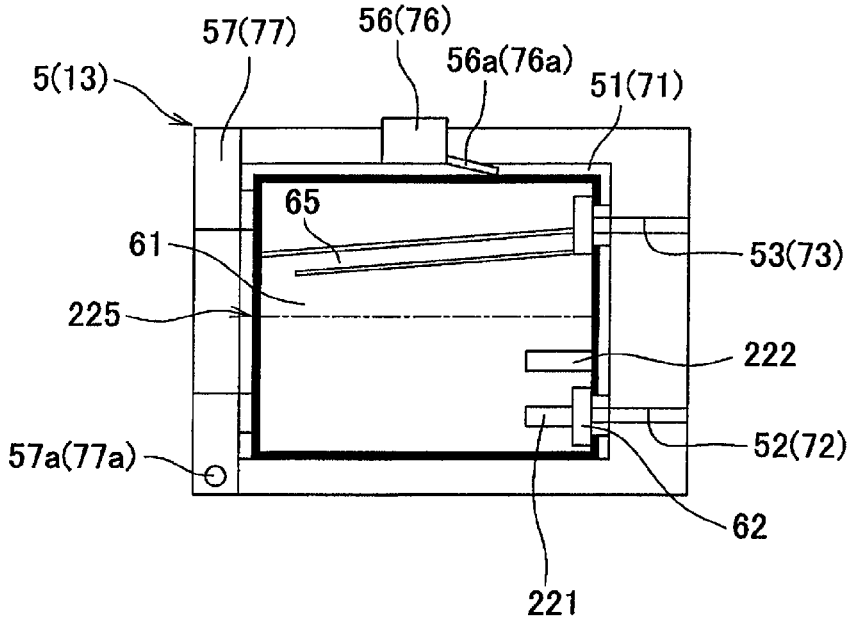
FIG. 11A relates to a variation 3 and is equivalent to FIG. 3B.
Figure 11B:
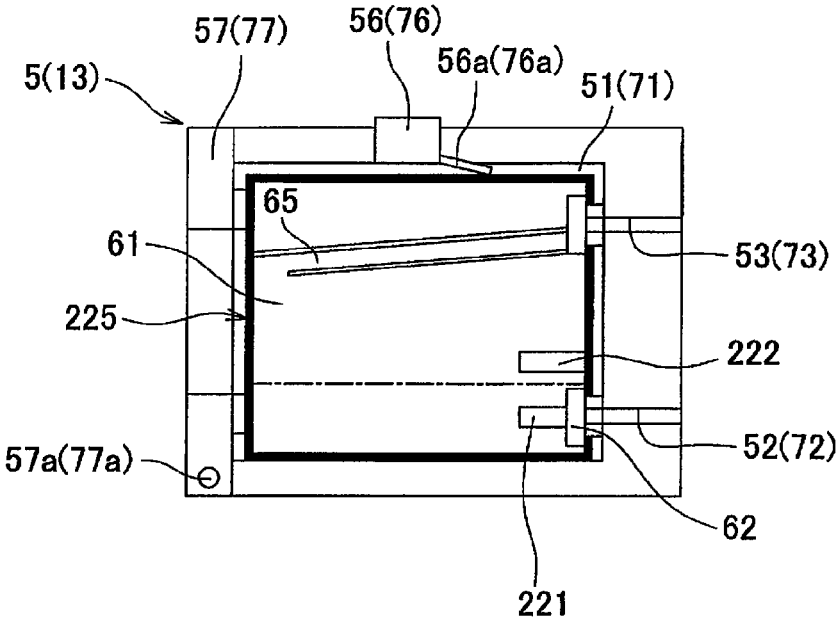
FIG. 11B relates to a variation 3 and is equivalent to FIG. 3C.

Furthermore, the present invention is not limited to the arrangement in which whether an ink cartridge is in the empty state is detected by using an object (movable unit) which moves in accordance with changes in the remaining amount of ink in the ink storage space 61. In another variation, as illustrated in FIGS. 11A and 11B, an ink cartridge 225 is arranged so that a lower electrode 221 which extends toward the left from the ink supplying unit 62 and an upper electrode 222 which extends toward the left from the right-side wall above the ink supplying unit 62 in the figures are provided in the ink storage space 61, in place of the rotating component 64. In the meanwhile, each of a first cartridge attaching unit 205 and a second cartridge attaching unit 213 is not provided with a light emitting unit and a light receiving unit. In place of such units, each cartridge attaching unit is provided with a component such as an unillustrated circuit which is configured to detect the electric resistance between the lower electrode 221 and the upper electrode 222 when an ink cartridge 25 is attached (variation 3).

In this variation, when, as illustrated in FIG. 11A, the liquid surface of the ink in the ink storage space 61 is on the same level or higher than the upper electrode 222 and the upper electrode 222 contacts the ink, the electric resistance between the upper electrode 222 and the lower electrode 221 is low because these electrodes are electrically connected via the ink.

On the other hand, when, as illustrated in FIG. 11B, the remaining amount of the ink in the ink storage space 61 is smaller than a predetermined remaining amount and hence the liquid surface of the ink is lower than the upper electrode 222, the upper electrode 222 and the lower electrode 221 are not electrically connected via the ink because the upper electrode 222 does not contact the ink, with the result that the electric resistance between the electrodes is high.

The first empty detector 114 and the second empty detector 116 detect whether the ink cartridges 225 attached to the first cartridge attaching unit 205 and the second cartridge attaching unit 213 are in the empty state, based on the electric resistance between the upper electrode 222 and the lower electrode 221 which is detected by the above-described circuit.

In this variation, the lower electrode 221 and the upper electrode 222 are equivalent to the section for detection of the present invention, a combination of the first empty detector 114 and the circuit which detects the electric resistance between the lower electrode 221 and the upper electrode 222 is equivalent to the first empty detector of the present invention, and a combination of the aforesaid circuit and the second empty detector 116 is equivalent to the second empty detector of the present invention.

The section for detection of the present invention used for detecting whether an ink cartridge is in the empty state is not limited to a component provided inside the ink storage space 61, such as the rotating component 64 of the present embodiment and the lower electrode 221 and the upper electrode 222 of the variation 3. In this regard, the section for detection of the present invention may be provided at a part different from the inside of the present invention, for example a light transmissive window is formed at a part of the side wall of an ink cartridge, as a section for detection which allows the liquid level of the ink in the ink storage space 61 to be viewable from the outside. According to this arrangement, whether the ink cartridge is in the empty state is detected by detecting the level of the liquid surface of the ink through the light transmissive window by using various sensors of the printer.

Figure 12:
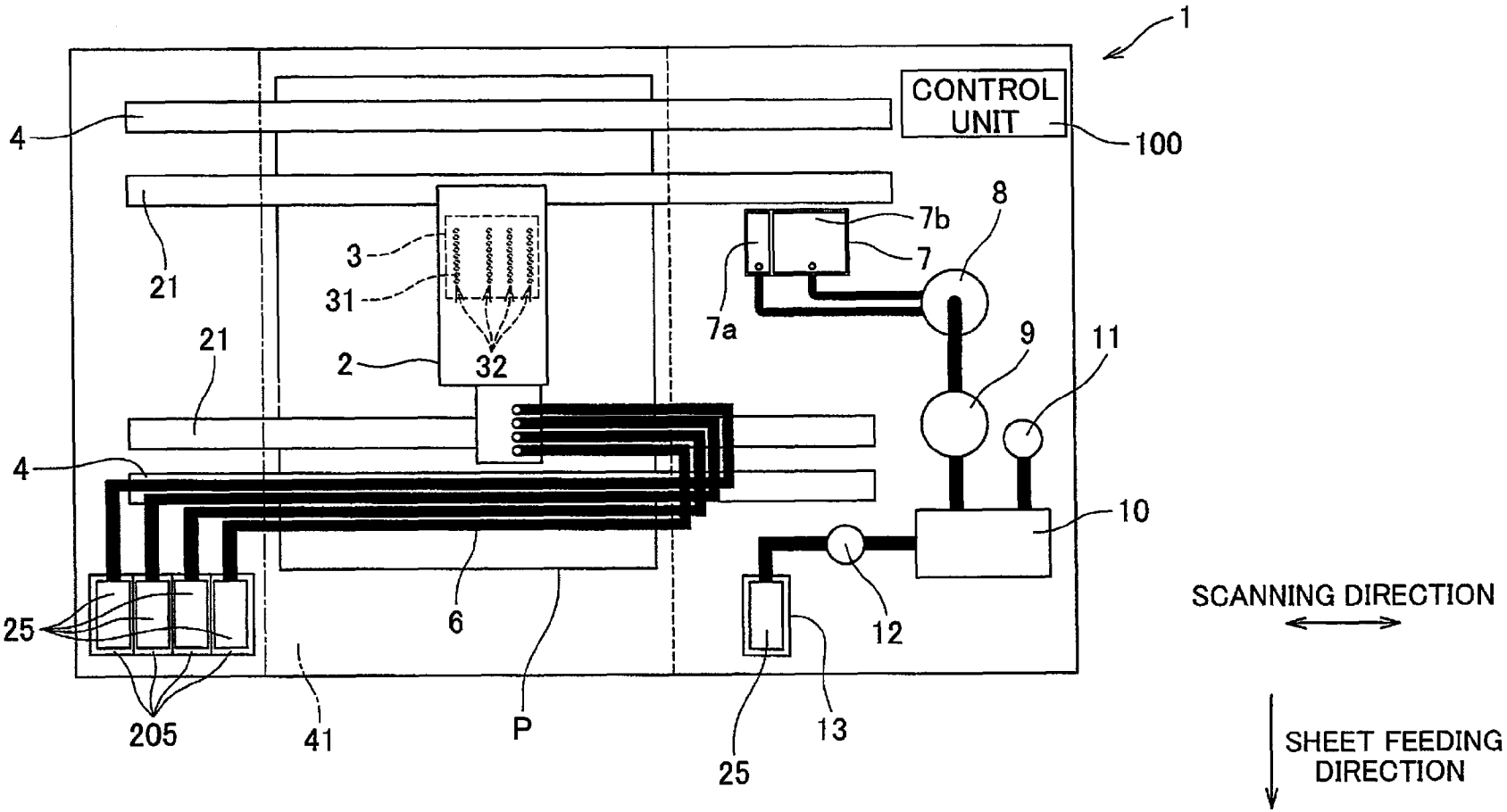
FIG. 12 relates to a variation 4 and is equivalent to FIG. 1.

In addition to the above, although in the present embodiment both of the first cartridge attaching unit 5 and the second cartridge attaching unit 13 are provided to the right of the sheet conveyance path 41 in FIG. 1, the present invention is not limited to this. In another variation, as illustrated in FIG. 12, a first cartridge attaching unit 205 is provided to the left of the sheet conveyance path 41, so that the first cartridge attaching unit 205 opposes the second cartridge attaching unit 13 in the scanning directions over the sheet conveyance path 41 (variation 4).

In the embodiment above, both the first cartridge attaching unit 5 and the second cartridge attaching unit 13 are disposed to the right of the sheet conveyance path 41, and the suction cap 7, the switching unit 8, the pump 9, and the storage tank 10 are also disposed to the right of the sheet conveyance path 41. The printer 1 is therefore required to have a space where the aforesaid components are disposed to the right of the sheet conveyance path 41. This may require the printer 1 to be large in size.

In this regard, the embodiment above is arranged so that the guides 21 extend beyond the boundaries of a sheet conveyance path 41 in both scanning directions, in such a way as to allow the carriage 2 to reciprocate in the scanning directions beyond the boundaries of the sheet conveyance path 41. The printer 1 therefore has spaces to the right and left of the sheet conveyance path 41.

In the variation 4, the first cartridge attaching unit 205 is disposed in the space to the left of the sheet conveyance path 41. It is therefore possible to downsize the printer 1 by, for example, as illustrated in FIG. 12, disposing the second cartridge attaching unit 13 in the space (see FIG. 1) where the first cartridge attaching unit 5 is originally disposed and disposing the components such as the switching unit 8, the pump 9, and the storage tank 10 in the space where the second cartridge attaching unit 13 is originally disposed.

In addition to the above, because ink cartridges 25 are attached to both of the first cartridge attaching unit 5 and the second cartridge attaching unit 13, an ink cartridge 25 may be mistakenly attached to a wrong attaching unit when the first cartridge attaching unit 5 and the second cartridge attaching unit 13 are disposed on the same side of the sheet conveyance path 41 in the scanning directions and are therefore close to each other. In the variation 4, however, the first cartridge attaching unit 205 and the second cartridge attaching unit 13 oppose each other over the sheet conveyance path 41 and hence they are far from each other. This reduces the likelihood of mistakenly attaching a ink cartridge 25.

It is noted that a similar effect is achieved when the second cartridge attaching unit is disposed to the left of the sheet conveyance path 41, instead of disposing the first cartridge attaching unit in the space to the left of the sheet conveyance path 41. In this case, however, the path that connects the storage tank 10 with the second cartridge attaching unit must be disposed to cross over the sheet conveyance path 41. For this reason, unlike the embodiment above, it is necessary to contemplate the arrangement of that path.

Also in the case above, since the path connecting the storage tank 10 with the second cartridge attaching unit is long, it is necessary to set the pressure of the pump 9 to be high enough to convey ink from the storage tank 10 to the ink cartridge 25 attached to the second cartridge attaching unit.

In addition to the above, the present invention is not limited to the embodiment above in which the first cartridge attaching unit 5 is connected to the inkjet head 3 via the tube 6 and hence an ink cartridge 25 is connected to the inkjet head 3 after being attached to the first cartridge attaching unit 5.

In this regard, other alternatives can be thought of to dispose the first cartridge attaching unit in such a way as to allow the ink cartridge 25 to supply ink to the inkjet head 3. For example, the first cartridge attaching unit is provided on the carriage 2 and the first cartridge attaching unit is connected to the inkjet head 3 on the carriage 2. Alternatively, the first cartridge attaching unit is provided in the vicinity of the guides 21. In this case, the first cartridge attaching unit is not connected to the inkjet head 3 when ink is not supplied to the inkjet head 3, and the carriage 2 moves to the vicinity of the first cartridge attaching unit and hence the inkjet head 3 is connected to the first cartridge attaching unit only when ink is supplied to the inkjet head 3.

In addition to the above, the present invention is not limited to the embodiment above in which the liquid level sensor 14 and the storage amount detector 117 detect whether an amount of ink in the storage tank 10 is not lower than the reference storage amount, and the ink is conveyed from the storage tank 10 to the ink cartridge 25 attached to the second cartridge attaching unit 13 only when the amount of ink in the storage tank 10 becomes equal to or larger than the reference storage amount. For example, it is detected that a sufficient amount of ink has been conveyed to the storage tank 10 either each time a predetermined period of time elapses or each time ink in the inkjet head 3 is sucked a predetermined number of times, and the conveyance of ink from the storage tank 10 to the ink cartridge 25 attached to the second cartridge attaching unit 13 is carried out.

In addition to the above, the present invention is not limited to the embodiment above in which the predetermined conveyance amount of ink conveyed from the storage tank 10 to the ink cartridge 25 attached to the second cartridge attaching unit 13 is detected in such a way that the ink is conveyed not only to the ink storage space 61 but also to the air passage 65 in the end. It is possible to detect the predetermined conveyance amount such that ink is conveyed not to the air passage 65 but only to the ink storage space 61, i.e. detect the predetermined amount to be equal to or lower than a result of subtracting the predetermined remaining amount from the capacity of the ink storage space 61.

In addition to the above, the present invention is not limited to the embodiment above in which the ink sucked from the inkjet head 3 through the nozzles 31 is conveyed to the storage tank 10 and the ink cartridge 25 attached to the second cartridge attaching unit 13. In this regard, there are types of inks such as ink ejected to the cap or to an ink absorbing foam through the nozzles 31 by pressuring ink in a pressure chamber, i.e. ink ejected by so-called flushing, and ink which is discharged along with air when so-called discharge air purge is conducted so that air in the inkjet head 3 is discharged. Such types of inks may be conveyed to the storage tank 10 and the ink cartridge 25 attached to the second cartridge attaching unit 13.

In the explanation above, the present invention is used in a printer having an inkjet head which ejects ink onto a record sheet through nozzles. Alternatively, the present invention may be used in a liquid ejector which ejects a liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejector comprising:

a liquid ejection head which ejects a liquid through a nozzle;

a first cartridge attaching unit to which a first liquid cartridge is attached in such a way that a liquid is supplyable to the liquid ejection head, the first liquid cartridge including a first section for detection which is used for detecting whether the first liquid cartridge is in an empty state in which an amount of an internal liquid is less than a predetermined remaining amount;

a discharge path used for discharging the liquid from the liquid ejection head;

a second cartridge attaching unit to which a used liquid cartridge including a second section for detection, which is used and is in the empty state because a liquid therein has been consumed is attached, so that the used liquid cartridge is connected to a downstream end of the discharge path;

a pump which is provided in the middle of the discharge path and conveys a liquid in the discharge path to the used liquid cartridge attached to the second cartridge attaching unit;

a first empty detector which detects, using the first section for detection, whether the first liquid cartridge attached to the first cartridge attaching unit is in the empty state;

an attachment detector which detects whether the used liquid cartridge is attached to the second cartridge attaching unit;

a second empty detector which detects, using the second section for detection, whether the used liquid cartridge attached to the second cartridge attaching unit is in the empty state; and a control unit which controls the pump, wherein, when an discharge possible state is established where the attachment detector has detected that the used liquid cartridge is attached to the second cartridge attaching unit and the second empty detector has detected that the used liquid cartridge is in the empty state, the control unit controls the pump in such a way that a predetermined conveyance amount of the liquid is conveyed to the used liquid cartridge attached to the second cartridge attaching unit after the liquid is conveyed from the discharge path to the used liquid cartridge until the second empty detector detects that the used liquid cartridge is no longer in the empty state, and wherein, on the discharge path, a storage tank which temporarily stores a liquid in the discharge path is provided between the pump and the second cartridge attaching unit, and the pump conveys the liquid in the storage tank to the used liquid cartridge attached to the second cartridge attaching unit.

2. The liquid ejector according to claim 1, wherein, each of the first section for detection and the second section for detection has a movable unit which moves in accordance with a remaining amount of the liquid in the first liquid cartridge or the used liquid cartridge, and each of the first empty detector and the second empty detector detects whether the first liquid cartridge and the used liquid cartridge, respectively, is in the empty state by detecting the position of the movable unit.

3. The liquid ejector according to claim 2, wherein, each of the first empty detector and the second empty detector has a first light emitting unit which emits light and a first light receiving unit which receives the light emitted from the first light emitting unit, and the movable unit is arranged to be able to block the light emitted from the first light emitting unit and is arranged to be switchable between a first position to block the light emitted from the first light emitting unit and a second position not to block the light emitted from the first light emitting unit, based on whether the amount of the liquid in the first liquid cartridge or the used liquid cartridge is less than the predetermined remaining amount.

4. The liquid ejector according to claim 3, wherein, the second section for detection has a rotating component which includes the movable unit, is provided in a space to which the liquid is supplied in the used liquid cartridge, and rotates in accordance with a change in the remaining amount of the liquid in the used liquid cartridge, and the movable unit is switched between the first position and the second position in accordance with the rotation of the rotating component.

5. The liquid ejector according to claim 3, wherein, the attachment detector includes:

the first light emitting unit and the first light receiving unit constituting the second empty detector;

a second light emitting unit which is at a different position from the first light emitting unit and emits light; and a second light receiving unit which is at a different position from the first light receiving unit and receives the light emitted from the second light emitting unit, and the second light emitting unit and the second light receiving unit are arranged so that the light emitted from the second light emitting unit is blocked by the movable unit when the movable unit is in the second position.

6. The liquid ejector according to claim 1, further comprising a liquid amount detector which detects whether an amount of the liquid stored in the storage tank is not less than a predetermined reference storage amount, wherein, the control unit controls the pump in such a way that the liquid is conveyed from the storage tank to the used liquid cartridge attached to the second cartridge attaching unit only when the liquid amount detector detects that the amount of the liquid stored in the storage tank is not less than the reference storage amount.

7. The liquid ejector according to claim 1, wherein, the control unit controls the pump so that the liquid is not conveyed from the discharge path to the used liquid cartridge attached to the second cartridge attaching unit, either when the attachment detector has not detected that the used liquid cartridge is attached to the second cartridge attaching unit or when the attachment detector detects that the used liquid cartridge is attached to the second cartridge attaching unit but the second empty detector detects that the used liquid cartridge attached to the second cartridge attaching unit is not in the empty state.

8. The liquid ejector according to claim 1, wherein, after the predetermined conveyance amount of the liquid is conveyed to the used liquid cartridge attached to the second cartridge attaching unit, the control unit controls the pump so that the liquid is not conveyed from the discharge path to the used liquid cartridge until it is detected that the discharge possible state is recovered.

9. The liquid ejector according to claim 1, further comprising a liquid target medium carrier unit which carries a liquid target medium on which the liquid ejected from the liquid ejection head lands, in a predetermined single direction along a predetermined conveyance path, wherein, the liquid ejection head is structured to be able to cross over the conveyance path, in directions perpendicular to the predetermined single direction, and the first cartridge attaching unit opposes the second cartridge attaching unit over the conveyance path.

10. A liquid ejector comprising:

The liquid ejector according to claim 6, wherein, the used liquid cartridge includes a liquid storage space and an atmosphere passage which connects the liquid storage space with an outside, and the predetermined conveyance amount is greater than a result of subtracting the predetermined remaining amount from the capacity of the liquid storage space and is less than a result of subtracting the predetermined remaining amount from the total of the capacity of the liquid storage space and the capacity of the atmosphere passage.

* * * * *